US011047381B2

(12) United States Patent
Rini et al.

(10) Patent No.: US 11,047,381 B2
(45) Date of Patent: Jun. 29, 2021

(54) METHOD AND APPARATUS FOR ORIENTATION INDEPENDENT COMPRESSION

(75) Inventors: Daniel P. Rini, Orlando, FL (US); Benjamin Saarloos, Orlando, FL (US); Brian Zinck, Chuluota, FL (US); Nick Williams, Orlando, FL (US); James Hughes, Winter Park, FL (US)

(73) Assignee: RINI TECHNOLOGIES, INC., Oviedo, FL (US)

( * ) Notice: Subject to any disclaimer, the term of this patent is extended or adjusted under 35 U.S.C. 154(b) by 562 days.

(21) Appl. No.: 12/620,443

(22) Filed: Nov. 17, 2009

(65) Prior Publication Data

US 2010/0132382 A1 Jun. 3, 2010

Related U.S. Application Data

(60) Provisional application No. 61/115,429, filed on Nov. 17, 2008.

(51) Int. Cl.
*F04B 53/18* (2006.01)
*F04B 53/08* (2006.01)
(Continued)

(52) U.S. Cl.
CPC ..... *F04B 53/18* (2013.01); *F04B 53/08* (2013.01); *F04C 29/02* (2013.01); *F25B 31/002* (2013.01);
(Continued)

(58) Field of Classification Search
CPC ..... F04B 53/18; F04B 53/08; F04C 29/02; F04C 18/22; F04C 2210/10;
(Continued)

(56) References Cited

U.S. PATENT DOCUMENTS 1,569,499 A 1/1926 Emil
1,896,081 A 2/1933 Hampson
(Continued)

FOREIGN PATENT DOCUMENTS

AU 131220 * 3/1947
CH 106312 A 1/1925
(Continued)

OTHER PUBLICATIONS

Li, Q. et. al. "Heat Transfer and Pressure Drop Characteristics in Rectangular Channels with Elliptic Pin Fins," *International Journal of Heat and Fluid Flow*, 1998, pp. 245-250, vol. 19.
(Continued)

*Primary Examiner* — Jiangying C Atkisson
*Assistant Examiner* — Miguel A Diaz
(74) *Attorney, Agent, or Firm* — Saliwanchik, Lloyd & Eisenschenk

(57) ABSTRACT

The subject invention pertains to a method and apparatus for an orientation independent compressor. The subject compressor can be part of a vapor compression cycle system, and can use one or more of a variety of working fluids, including, but not limited to, refrigerants such as r-134a, r-22, $CO_2$, and $NH_3$. Embodiments of the compressor can utilize positive displacement apparatus to compress the vapor. In a specific embodiment, the compressor can incorporate an oil-lubricated rotary lobed type positive displacement compressor. In a further specific embodiment, the working fluid vapor can be a refrigerant, such as r-134a, incorporating entrained oil, such as miscible lubricating oils. An example of such a miscible lubricating oil that can be used is polyester (POE) oil.

57 Claims, 14 Drawing Sheets

(51) Int. Cl.
*F25B 31/00* (2006.01)
*F04C 29/02* (2006.01)
*F04C 18/22* (2006.01)

(52) U.S. Cl.
CPC ..... *F04C 18/22* (2013.01); *F04C 2210/10* (2013.01); *F04C 2210/1027* (2013.01); *F04C 2210/1072* (2013.01); *F04C 2210/266* (2013.01); *F25B 2500/01* (2013.01)

(58) Field of Classification Search
CPC ..... F04C 29/1027; F04C 29/1072; F04C 29/266; F25B 31/002; F25B 2500/01
USPC ..... 62/468, 169, 192, 84, 401, 402; 417/53, 417/228; 418/61.2, 83, 84, 87, 91, 99, 418/100
See application file for complete search history.

(56) References Cited

U.S. PATENT DOCUMENTS

| | | | | |
|---|---|---|---|---|
| 1,896,953 | A | 2/1933 | Hassell | |
| 1,974,317 | A | 9/1934 | Steenstrup | |
| 2,566,865 | A | 9/1951 | Wingerter | |
| 2,768,508 | A | 10/1956 | Guyton | |
| 2,920,463 | A | 1/1960 | Gould | |
| 3,152,455 | A | 10/1964 | Ware | |
| 3,200,480 | A | 8/1965 | Heuer | |
| 3,214,087 | A | 10/1965 | Luck | |
| 3,248,020 | A * | 4/1966 | Spalding | F04B 7/04 222/243 |
| 3,529,432 | A | 9/1970 | Nussbaum | |
| 3,555,848 | A | 1/1971 | Johnson | |
| 3,558,248 | A * | 1/1971 | Parker | 418/88 |
| 3,877,247 | A | 4/1975 | Le Couturier | |
| 3,926,008 | A | 12/1975 | Webber | |
| 4,287,724 | A | 9/1981 | Clark | |
| 4,300,630 | A | 11/1981 | Trojani | |
| 4,555,915 | A | 12/1985 | Dasher | |
| 4,630,669 | A | 12/1986 | Kessler et al. | |
| 5,097,897 | A | 3/1992 | Watanabe et al. | |
| 5,452,585 | A * | 9/1995 | Pincus et al. | 62/84 |
| 5,502,983 | A | 4/1996 | Dasher | |
| 5,511,384 | A | 4/1996 | Likitcheva | |
| 5,570,583 | A | 11/1996 | Boehde et al. | |
| 5,660,050 | A | 8/1997 | Wilson et al. | |
| 5,950,445 | A | 9/1999 | Wang | |
| 5,974,828 | A | 11/1999 | Guerand | |
| 6,056,891 | A * | 5/2000 | Goble | 252/67 |
| 6,370,775 | B1 | 4/2002 | Reagen et al. | |
| 6,499,534 | B1 | 12/2002 | Tawney et al. | |
| 7,010,936 | B2 | 3/2006 | Rini et al. | |
| 2006/0267600 | A1 * | 11/2006 | Beatty | F04C 29/026 324/698 |
| 2007/0086904 | A1 * | 4/2007 | Gray | F04B 13/00 417/417 |
| 2008/0245127 | A1 * | 10/2008 | Staffend | F04C 2/3446 72/370.01 |
| 2010/0043631 | A1 * | 2/2010 | Hamlin | F16J 1/08 92/158 |
| 2010/0132382 | A1 * | 6/2010 | Rini | F04B 53/08 62/84 |

FOREIGN PATENT DOCUMENTS

| | | | | |
|---|---|---|---|---|
| DE | 160351 | C | 5/1905 | |
| DE | 848656 | C | 9/1952 | |
| EP | 0438922 | A1 * | 7/1991 | F25B 31/00 |
| FR | 971287 | A | 1/1951 | |
| FR | 1158943 | A | 6/1958 | |
| GB | 1590923 | A | 6/1981 | |
| GB | 2107852 | A | 5/1983 | |

OTHER PUBLICATIONS

Ogura, I., "The Ogura-Wankel compressor-Application of Wankel Rotary Concept as Automotive Air Conditioning Compressor," *International Congress & Exposition*, Feb. 22-26, 1982, Detroit, Michigan.
XP001187086, "Advanced Lightweight Microclimate Cooling System (ALMCS)," *Natick Soldier Center*, Dec. 19, 2001.
XP001187087, "Portable Vapor-Compression Cooling System (PVCS)," *Natick Soldier Center*, Dec. 19, 2001.
International Search Report for International Application No. PCT/US2003/030113, dated Jul. 15, 2004.

* cited by examiner

METHOD AND APPARATUS FOR ORIENTATION INDEPENDENT COMPRESSION

CROSS-REFERENCE TO RELATED APPLICATION

The present application claims the benefit of U.S. Provisional Application Ser. No. 61/115,429, filed Nov. 17, 2008, which is hereby incorporated by reference herein in its entirety, including any figures, tables, or drawings.

BACKGROUND OF INVENTION

With respect to conventional compressors, the lubrication of the moving compressor parts is achieved by separated oil drawn from the oil-vapor mixture that exits the compressor. The oil can be separated from the oil vapor mixture by an oil separator and collected into an oil sump that supplies the compressor with oil for proper operation. On the compressor exhaust, after compression, the exhausted fluid consists of an oil-vapor mixture. Prior to sending the oil-vapor mixture to further components in the vapor compression system, the oil drops out of the flow inside the oil separator and is separated from the vapor and can be fed to an oil sump through gravity acting on the oil. The vapor only is then exited to the further components in the system. The separated oil is then directed back to the compressor inlet without traveling through the remainder of the vapor compression system. In addition to oil separators with gravity oil-fed oil sumps to separate the oil from the vapor, other components such as accumulators and some evaporator types with oil bleed ports can be used to separate the oil from the vapor. Thus, with conventional compressors, the vast majority of the oil contained in the vapor compression system is kept inside the compressor and oil separation mechanism alone (stored in the oil sump or other device such as an accumulator), as it is in continuous recirculation between the compressor and oil separation mechanism.

Therefore, conventional compressors, requiring some form of an oil separation mechanism either through the use of oil separators or other means such as through the use of oil bleed lines from some evaporator types or accumulators, are commonly orientation dependent, meaning dependent on the orientation of the compressor and oil separation mechanism with respect to the surrounding gravitational field, due to the gravity dependence of the oil-sump requirement and the gravity dependent location of any oil bleed lines drawn from other devices such as accumulators. The movement of oil from the exhaust of the compressor to the oil separation mechanism and back to the compressor is gravity dependent. Accordingly, with conventional compressors, there exists certain compressor orientations that restrict or completely cut off the gravity driven flow of oil to the compressor due to improper oil levels or no oil at all being located in the designated areas of the supplied oil sump or other oil storage device. With inadequate or no oil lubrication, the compressor performance can be significantly reduced. Short term operation effects without adequate oil lubrication can include an increase in the compressor power required due to increase frictional effects from the sliding components, a reduction in the flow output per compressor stroke due to a reduction in gas sealing, and an increase in frictional heat resulting in an increase of the compressor temperature. Both higher compressor power and reduced flow output can adversely affect vapor compression cycle system performance. Long term compressor operation without adequate oil lubrication can damage vital compressor components thus causing the compressor to fail.

Therefore, there is a need in the art for an orientation independent compressor and an orientation independent vapor compression cycle system.

BRIEF SUMMARY

Embodiments of the subject invention pertain to a method and apparatus for an orientation independent compressor. Embodiments of the subject invention also relate to a method and apparatus for an orientation independent vapor compression cycle system. The subject compressor can be part of a vapor compression cycle system. Embodiments of the subject compressor can use one or more of a variety of working fluids, including, but not limited to, one or more gases, such as nitrogen, oxygen, hydrogen, and air, gas mixtures, and/or refrigerants such as r-134a, r-22, $CO_2$, and $NH_3$. Embodiments of the compressor can utilize positive displacement means to compress the vapor. In a specific embodiment, the compressor can incorporate an oil-lubricated rotary lobed type positive displacement compressor. In alternate embodiments, the compressor can operate on a different principle, such as a rotary compressor, a piston compressor, a screw compressor, a scroll compressor, or a centrifugal compressor. In a specific embodiment, the working fluid can be a refrigerant incorporating entrained oil. In a further specific embodiment, the working fluid can be a hydrogen fluorocarbon (HFC) refrigerant, such as r-134a, incorporating entrained oil, such as miscible lubricating oils. Examples of such miscible lubricating oils that can be used are mineral oils, Polyalkylene Glycol (PAG) oil, Alkylbenzene oil, and Polyol Ester (POE) oil.

In accordance with embodiments of the subject invention, proper compressor lubrication and operation is achieved by the oil-entrained working fluid vapor entering the compressor. Preferred embodiments can achieve proper compression lubrication without an oil separation mechanism and without the need for an oil sump to collect the separated oil. In accordance with embodiments of the subject invention, the oil-vapor mixture remains as a mixture upon entering and exiting the compressor within a flow path that does not allow significant amounts of, if any, oil to collect, so as to reduce the mass flow rate of oil entrained in the oil-entrained working fluid entering the compressor in a way so as to not adequately lubricate the compressor independent of the orientation of the compressor, with respect to the surrounding gravitational field.

The oil-vapor flow path can be achieved by actively minimizing the internal volumes of the compressor that can potentially fill with separated oil. When oil fills into such internal volumes, the oil loses contact with the working fluid due to the localized reduction in vapor velocity through the internal volume of flow path such that the oil in such internal volumes does not remain entrained with the working fluid vapor. By reducing the amount of internal volume that oil can reside so as to avoid the forces of the moving working fluid vapor, enough of the oil by volume is circulated in the working fluid though the vapor compression cycle and entrained in the flow path for the working fluid vapor and oil mixture at the compressor inlet and outlet, such that proper compressor lubrication can be achieved. In specific embodiments, more than 70%, more than 80%, and more than 90%, respectively, of the oil by volume is circulated in the working fluid through the vapor compression cycle and entrained in the flow path for the working fluid vapor, independent of the orientation of the compressor with respect to the surrounding gravitational field. In further embodiments, the amount of the lubricating oil entrained in the working fluid vapor, or oil mass flow rate, at any orientation of the compressor with respect to the surrounding gravitational field is at least 80%, at least 90%, and at least 95%, respectively, of the maximum amount of the lubricating oil entrained in the working fluid vapor, or maximum oil mass flow rate, where the maximum amount of the lubricating oil entrained in the working fluid, or maximum oil mass flow rate vapor is achieved at one or more orientations of the compressor, or vapor compression cycle system, that results in a maximum mass flow rate of lubricating oil being entrained in the working fluid vapor. In this way, the mass flow rate of oil entrained remains within a certain range of a maximum mass flow rate of oil, based on the mass flow rate of oil in the compressor, or vapor compression cycle system, and the design of the compressor, or vapor compression cycle system, respectively.

Achieving sufficient velocity for the working fluid vapor can ensure the movement of the working fluid vapor keeps the oil entrained in the working fluid vapor through the compressor from the compressor inlet (or suction side) to the compressor outlet (or discharge side). Sufficient fluid velocities also ensure proper oil propagation in the flow path connecting the compressor to the components incorporated in the vapor compression cycle. The relationship of the pressure differential between the input to the compressor and the output of the compressor, the volume of the flow path from the input of the compressor to the output of the compressor, the length of the flow path from the input of the compressor to the output of the compressor and the cross-sectional area of the flow path can assure the adequacy of the velocity of the working fluid vapor through the flow path through the compressor. In a specific embodiment using r-134a as a working fluid, the compressor and compressor flow path is designed to achieve a working fluid vapor velocity of 0.1 m/sec to 5 m/sec, so as to entrain the lubricating oil in the flowing working fluid vapor. In specific embodiments, using r-134a as a working fluid, an oil-entrained working fluid vapor velocity of at least 2 m/sec; of at least 3 m/sec; and in a range of 5-7 m/sec, is achieved. In addition, the structure of the vapor fluid flow path can be designed to maintain the velocity of the oil-entrained working fluid vapor above the minimum vapor velocity to maintain oil entrainment in the oil-vapor mixture. Straight sections of the internal flow path are preferred and smooth surfaces are preferred. The typical operating surface Roughness Average (Ra) range varies from 16 micro-inch Ra (ground) to 250 micro-inch Ra (milled), with a typical value of 63 micro-inch Ra (milled). If a bend in the vapor flow path cannot be avoided, slower curving angles, such as less than 60 degrees, are preferred to sharper angles, which include those angles greater than 60 degrees from the fluid direction. In specific embodiments, the operating flow path angles remain in the range 20-45 degrees. Fluid vapor flow path angles can incorporate radii of curvature that keep the working fluid flowing smoothly. In specific embodiments, the radii of curvature is greater than 0.025", and greater than 0.050".

In order to maintain an adequate oil-vapor mixture velocity, compressor internal volumes, often unavoidable during manufacture and compressor assembly, can be partially, or completely, filled. Internal volumes that can cause oil to be removed from the flow can be minimized, when possible, prior to manufacture. Empty volumes inside the compressor can be avoided during construction of the compressor and flow path, or can be filled with various filler materials, such as metals, epoxies, plastics, and rubbers once construction is complete. With few, if any, empty volumes or pockets for the oil to collect, the oil remains mixed with the refrigerant vapor as it travels to and from the compressor, and results in an oil mass flow balance across the compressor and the entire vapor compression cycle. The mass flow rate of oil that enters the compressor is equivalent to the mass flow rate of oil that exits the compressor and requires no oil separation mechanism.

In further embodiments, the flow path of the working fluid and oil outputted from the compressor into a vapor compression cycle system can be designed using the same techniques previously mentioned to reduce or eliminate empty spaces that can gather oil in a way that would impact the oil entrained in the working fluid entering the compressor. Preferably, the mass flow rate of oil that exits the compressor flows through the flow path and enters the compressor independent of the orientation to the surrounding gravitational field. In a specific embodiment, the mass flow rate of oil that enters the rest of the vapor compression system from the output port of the compressor is equal to the mass flow rate of oil that enters the input port of the compressor from the vapor compression system and the vapor compression system does not include any means of active oil separation, thus enabling gravitational independence. In this way, oil does not build up in internal volumes connected to the flow path when the vapor compression cycle system is in a first orientation, so as to be removed from the flow through the flow path, and then release back into the flow path when the orientation of the vapor compression cycle system is changed to a second orientation. After compression, the oil-vapor mixture is then directed to the next component in the vapor compression cycle. Components of a vapor compression cycle system can include, for example, a condenser, an expansion device, an evaporator, one or more filters, one or more receivers, one or more accumulators, one or more by-pass valves, and one or more interconnection tubes or other interconnection apparatus. In a specific embodiment, the working fluid and oil are outputted by the compressor, pass through a condenser, then pass through an expansion device, and finally pass through an evaporator before being inputted back into the compressor.

Embodiments of the subject invention can enable proper compressor operation largely, or completely, independent of compressor orientation with respect to the gravitation field. Orientation independence is accomplished by maintaining adequate oil lubrication in many, if not all, possible geometric orientations by removing the oil separation mechanisms, oil sumps, oil bypass and bleed lines, and other means of oil separation incorporated in conventional compressors. With embodiments of the subject invention, the oil and vapor remain mixed through the implementation of a clearly defined oil-vapor flow path by filling in, reducing, and/or eliminating, empty volumes for oil collection to occur. Removing the oil separation mechanisms that are gravity dependent allows proper compressor operation independent of the compressors orientation, whether vertical, horizontal, or in any other orientation angle.

DETAILED DISCLOSURE

Figure 1:
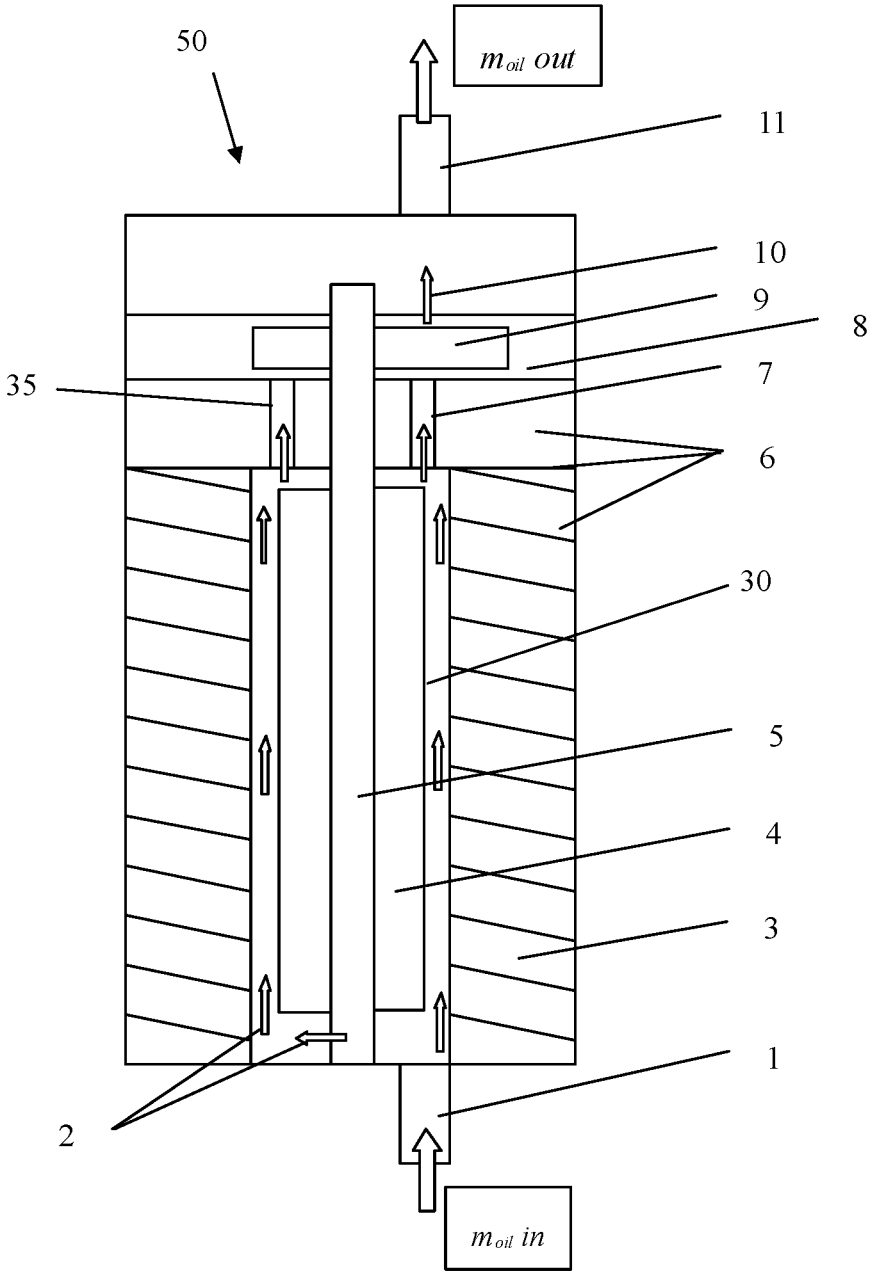
FIG. 1 shows an embodiment of the subject invention, showing a cross-sectional view of a compressor attached to an electric motor with the clearly defined, non-separated, oil-vapor mixture flow path illustrated.

Embodiments of the subject invention pertains to a method and apparatus for an orientation independent compressor. Embodiments of the subject invention also relate to a method and apparatus for an orientation independent vapor compression cycle system. The subject compressor can be part of a basic vapor compression cycle system using one or more of a variety of working fluids including, but not limited to, one or more gases, such as nitrogen, oxygen, hydrogen, and air, gas mixtures, and/or refrigerants such as hydrogen fluorocarbon (HFC) refrigerant, r-134a, r-22, $CO_2$, or $NH_3$. The compressor can utilize positive displacement means to compress the vapor. In a specific embodiment, the compressor can incorporate an oil-lubricated rotary lobed type positive displacement compression. In a specific embodiment, the working fluid can be a refrigerant incorporating entrained oil. In a further specific embodiment, the working fluid can be a refrigerant, specifically r-134a, containing entrained oil, such as miscible lubricating oils. Examples of such miscible lubricating oils that can be used are mineral oils, Polyalkylene Glycol (PAG) oil, Alkylbenzene oil, and Polyol Ester (POE) oil. The compressor requires oil for adequate lubrication so as to properly perform. A properly performing compressor is one in which required power and oil-vapor flow output are within acceptable levels needed for overall vapor compression cycle system operation. Inadequate lubrication can lead to higher required power, in addition to reduced flow output, both of which are unacceptable to proper performance. If a compressor is continued to operate with inadequate oil lubrication, compressor component accelerated wear and ultimately component failure can occur.

With respect to specific embodiments of the subject invention, proper compressor lubrication and operation is achieved without any oil separation mechanism and without an oil sump to collect the separated oil. This is in contrast to conventional compressors in which oil is contained and re-circulated between the compressor 50 and the oil separation mechanism after being separated and collected into an orientation dependent, gravity-fed oil sump or other gravity dependent oil storage vapor compression cycle component or device. By removing the oil separation mechanism needed to lubricate the compressor, orientation independence is achieved. While maintaining the oil-vapor mixture in the compressor as a mixture without any active oil separation mechanism either in the flow path first segment 30 leading to the inlet or the flow path second segment 35 leading to the outlet of the compressor in a clearly defined flow path, embodiments of the subject compressor is able to properly perform in any position, such as vertical, horizontal, or any other angled orientation. Specific embodiments can allow proper performance independent of angular rotation of the subject compressor as well as independent of the angle the compressor makes to the gravitational field.

In an embodiment, the oil-vapor mixture is kept as a mixture and is constrained within a clearly defined flow path by filling in empty volumes in the flow path after construction and actively minimizing the internal volumes in the design of the flow path prior to construction of the compressor, which can potentially fill with separated oil, such as when the localized vapor velocity falls below the minimum requirement to maintain oil entrainment. In an embodiment, this minimum is 2-3 m/s. In an embodiment, after filling in and minimizing empty internal volumes within the flow path, the sum of all the empty volumes in the flow path where the velocity is not enough to entrain the oil is less than 20 percent of the total value of the volume of the oil charge.

Empty volumes inside the compressor can be filled with various filler materials, such as metals, epoxies, plastics, rubbers, or any other filler material that is compatible with the mixture that is used in the particular vapor compression system 80. During the design phase, the internal structure of the flow path is preferably designed to avoid vapor velocities below the acceptable minimum, by, for example, including but not limited to, minimizing the number of sharp directional changes, such as directional changes greater than 70 degrees; incorporating radii of curvature for any flow path angles i with a radii of 0.050 in. or greater; and yielding operating surfaces 19 having finishes on internal parts, with an operating surface 19 having a finish value or Roughness Average (Ra) in the range of 16 (ground) to 250 micro-inch Ra (milled). With few, or no, empty volumes or pockets for the oil to collect by actively and properly designing the internal flow path and filling in any empty volumes remaining after construction, the oil remains mixed with the refrigerant vapor as it travels to and from the compressor 50 and results in an oil mass flow balance across the compressor, preferably without an oil separation mechanism. The mass flow rate of oil that enters the compressor is equivalent to the mass flow rate of oil that exits the compressor, which is equivalent to the mass flow rate of oil that enters the rest of the vapor compression system 80 from the oil-flow balanced compressor and the mass flow rate of oil that returns to the compressor from the vapor compression system.

After compression, the oil-vapor mixture can then be directed to the next component in the vapor compression system. In specific embodiments, the same techniques of filling in and minimizing the internal volumes in the compressor flow path are applied to the components of the vapor compression system as well, such that the vapor compression system becomes gravity and orientation independent in the same manner as the orientation independent compressor. Further, in addition to being orientation independent with respect to the surrounding gravitational field, embodiments of the subject compressor and/or vapor compression cycle system can be orientation independent with respect to acceleration of the compressor and/or vapor compression cycle system. Specific embodiments can be orientation independent with respect to accelerations up to 2 times gravity, 3 times gravity, and 5 times gravity, respectively.

By minimizing empty volumes for oil to accumulate, the oil charge becomes critical as there is no oil separation mechanism and no sump or other extra spaces to collect any excess oil added to the vapor compression system. In a specific embodiment, the oil mass flow rate can range from 0.1-10% of the vapor mass flow rate, with the range for a further specific embodiment of approximately 1-2% of the vapor mass flow rate. An adequate oil quantity present in the oil-vapor mixture allows proper compressor performance, and can ensure proper operation of other components in the vapor compression system. A shortage of oil can result in improper compressor performance due to inadequate lubrication. However, excess oil, as a percentage of the vapor mass flow rate, can lead to performance degradation on other components in the vapor compression cycle system, such as a heat transfer reduction in the evaporator and/or condenser.

The oil-entrained working fluid vapor is input into a compressor head input port 12, is compressed within the compressor head, and is output from the compressor head output port. In this way, in specific embodiments, the oil-entrained working fluid vapor can have an input pressure in the range of 20 to 100 psi upon entry of the compressor head and in the range of 150 to 350 psi upon exiting the compressor head. Other ranges can also be achieved for the input and output pressures. In specific embodiments, the output pressure to input pressure ratio can vary from 1.5 to 17.5. In specific embodiments, the differential between output pressure and input pressure can vary from 50 psi to 330 psi.

An embodiment of a compressor 50 in accordance with the subject invention is shown in FIG. 1. FIG. 1 shows a cross-sectional view of a positive displacement compressor directly attached to an electric motor driving the compressor shaft. The oil-vapor mixture can enter from the bottom of the compressor at the compressor intake 1, or input port. The oil-vapor mixture can then be directed up through the inside of the electric motor, through a first segment 30 of the flow path indicated by the flow arrows 2. The oil-vapor mixture flow can be directed between the electric motor stator windings 3 and the electric motor rotor 4 that drives the compressor shaft 5. The filler material 6 can fill in some, or all, of the empty spaces to clearly define the first segment of the oil-vapor flow path. The filler material can include metals, epoxies, plastics, rubbers, or any other material that is compatible with the oil-vapor mixture. In the specific embodiment, the filler material 6 is an epoxy to completely fill in the voids found in the electric motor stator windings 3 and a combination of aluminum and epoxy define the flow path through the inlet manifold 7. In addition, epoxy can be used to fill in the gap between the top of the electric motor stator windings 3 and the bottom of the inlet manifold 7.

After the oil-vapor mixture travels through the inlet manifold 7, the oil-vapor mixture can enter into the compression housing 8, through a compressor head input port 12, and can be subsequently compressed by the compressor rotary lobe 9. The compressed oil-vapor mixture can then be outputted out of the compressor head output port 18 and passed through the outlet manifold 10. In the specific embodiment, the oil-vapor mixture is guided through a flow path in the outlet manifold 10 by filling in any extra volume with aluminum. The compressed oil-vapor mixture can then be exited through the outlet 11, or output port, of the compressor and can be directed to further vapor compression system 80 components without any oil separation or accumulation having taken place within the compressor. The mass flow rate of oil that was entrained in the vapor at the inlet of the compressor 1 is equivalent to the mass flow rate of oil that is entrained in the vapor at the outlet 11 of the compressor 50. This oil mass balance then enables orientation independent operation, as many, if not all, empty spaces in 3, 7, and 10 were actively filled in with material to clearly define the non-separated, oil-vapor mixture flow path.

Figure 2:
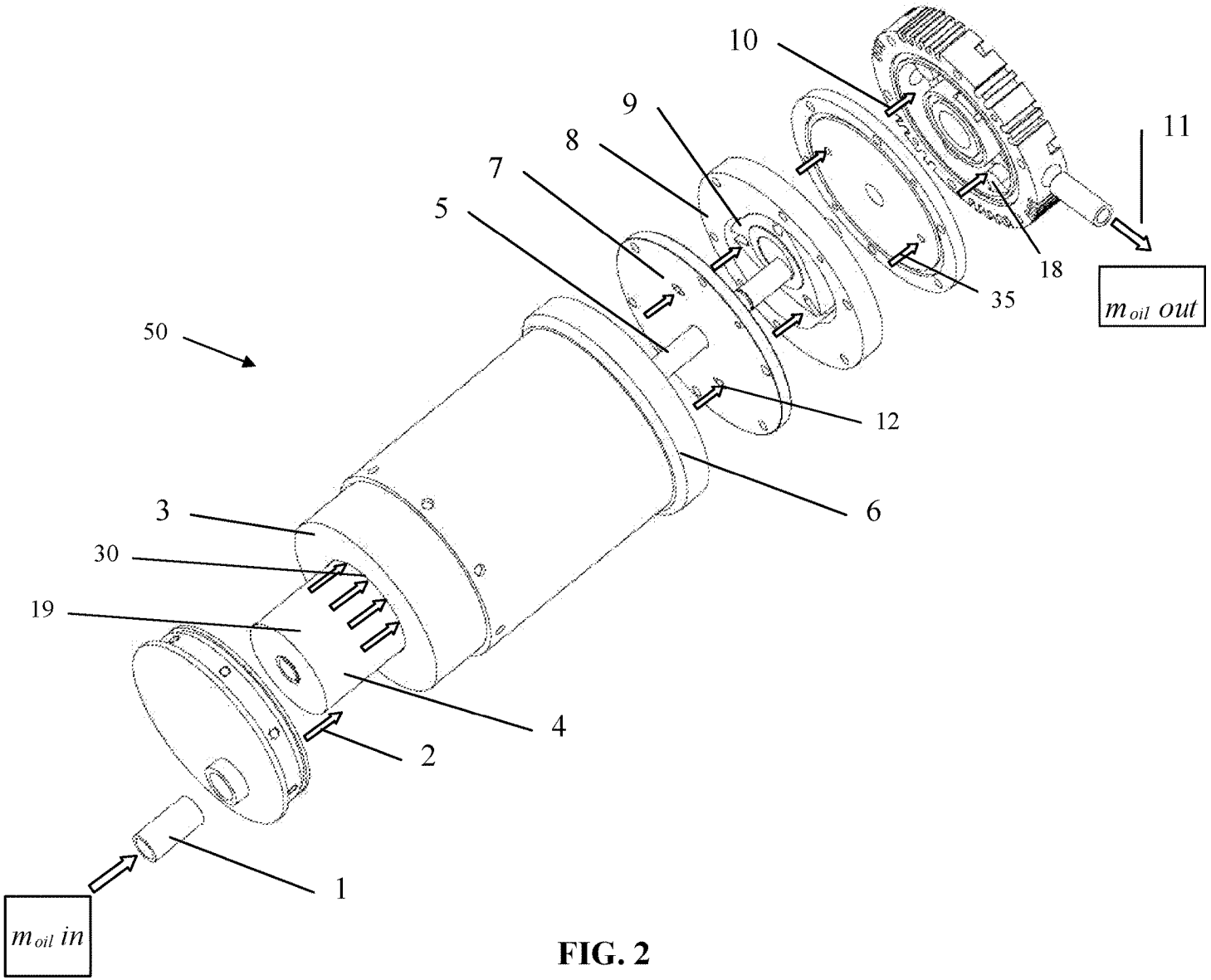
FIG. 2 shows a perspective, exploded view of an embodiment of a compressor in accordance with an embodiment of the subject invention.
Figure 3:
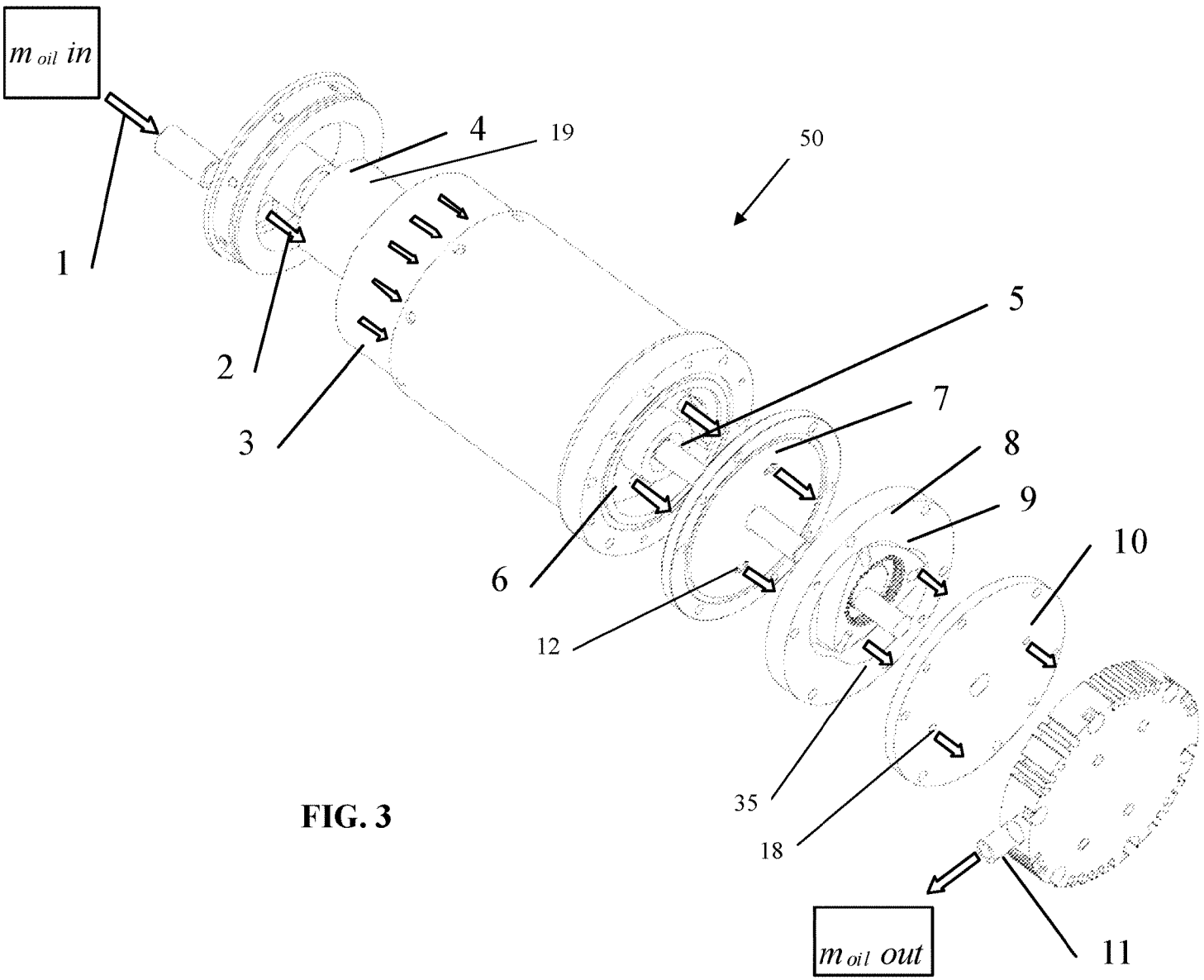
FIG. 3 shows another perspective, exploded view of the embodiment of FIG. 2.
Figure 4:
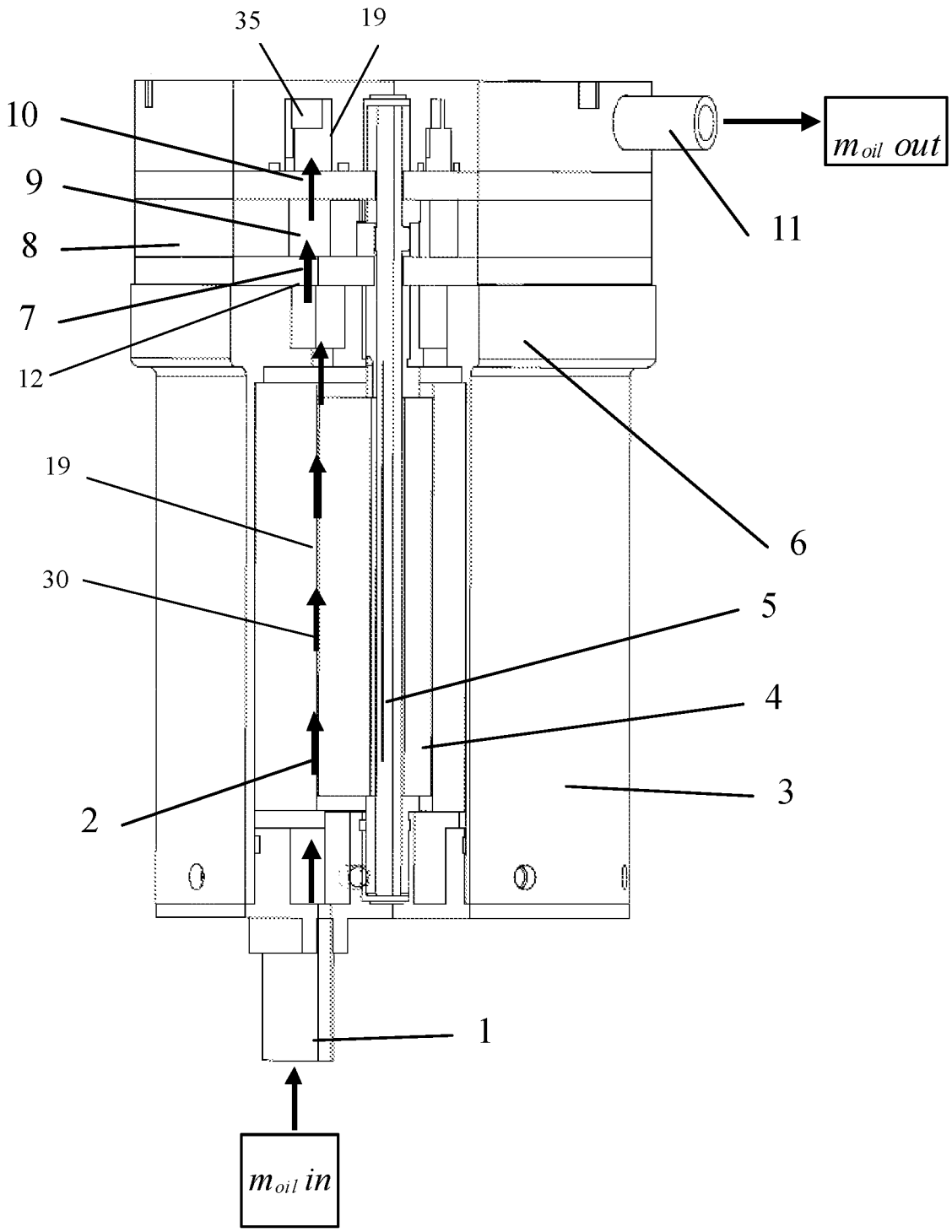
FIG. 4 shows a side view, with cut away, of the embodiment of FIG. 2.

FIGS. 2 and 3 show perspective, exploded views from different angles of a specific embodiment of a compressor that is similar to the compressor shown in FIG. 1. FIG. 4 shows a side view, with cut away, of the embodiment of FIGS. 2 and 3. The reference numbers on FIGS. 2, 3, and 4 correspond to similar structures as referenced by the same reference numbers in FIG. 1, where reference number 6 tries to show some of the locations that can have filled spaces that were once empty spaces that could trap the lubricating oil. Advantageously, as compressors in accordance with the subject invention do not need oil sumps, the compressors shown in FIGS. 1-4 can be operated, with appropriate modifications of the compressor head as needed, with the working fluid going in the opposite direction as shown in FIGS. 1-4.

Figure 5:
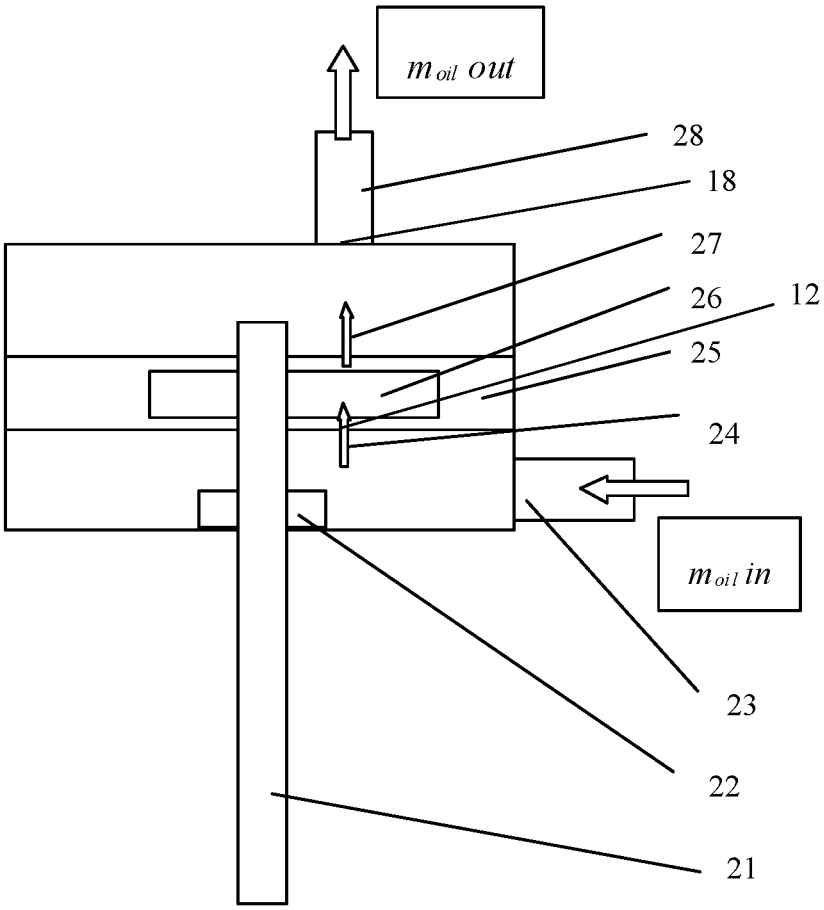
FIG. 5 shows an embodiment of the subject invention, showing a cross-sectional view of a compressor using a shaft seal with the clearly defined, non-separated, oil-vapor flow path illustrated.

In the embodiment shown in FIG. 5, a cross-sectional view of a positive displacement compressor is shown with a shaft seal 22 preventing the oil-vapor mixture from leaking down the compressor shaft 21. The oil-vapor mixture can enter the compressor from a side inlet 23, or compressor input port. After entering the compressor, the oil-vapor mixture is guided through a flow path through the inlet manifold 24. Filler materials can be used in inlet manifold 24 to form the oil-vapor mixture flow path to reduce, or prevent any oil separation and accumulation. In the specific embodiment, the filler material used in 24 is a combination of epoxy and aluminum. Once passed through the inlet manifold 24, the oil-vapor mixture can enter into the compression housing 25, e.g., through a compressor head input port 12, and can be subsequently compressed by the compressor rotary lobe 26. The compressed oil-vapor mixture can then be outputted out of a compressor head output port 18 and passed through the outlet manifold 27 in a clearly defined path. In the specific embodiment, the oil-vapor mixture the flow path in the outlet manifold 27 is formed by filling in any extra volume with aluminum. The compressed oil-vapor mixture can then be exited through the outlet 28 of the compressor, e.g., compressor output port, and can be directed to further vapor compression system 80 components without any oil separation or accumulation having taken place within the compressor. The mass flow rate of oil that was entrained in the vapor at the inlet of the compressor 23 is equivalent to the mass flow rate of oil that is entrained in the vapor at the outlet of the compressor 50. This oil mass balance then enables orientation independent operation, as many, if not all, empty spaces in 24 and 27 were actively filled in with filler material to clearly define the non-separated, oil-vapor mixture flow path.

Figure 6:
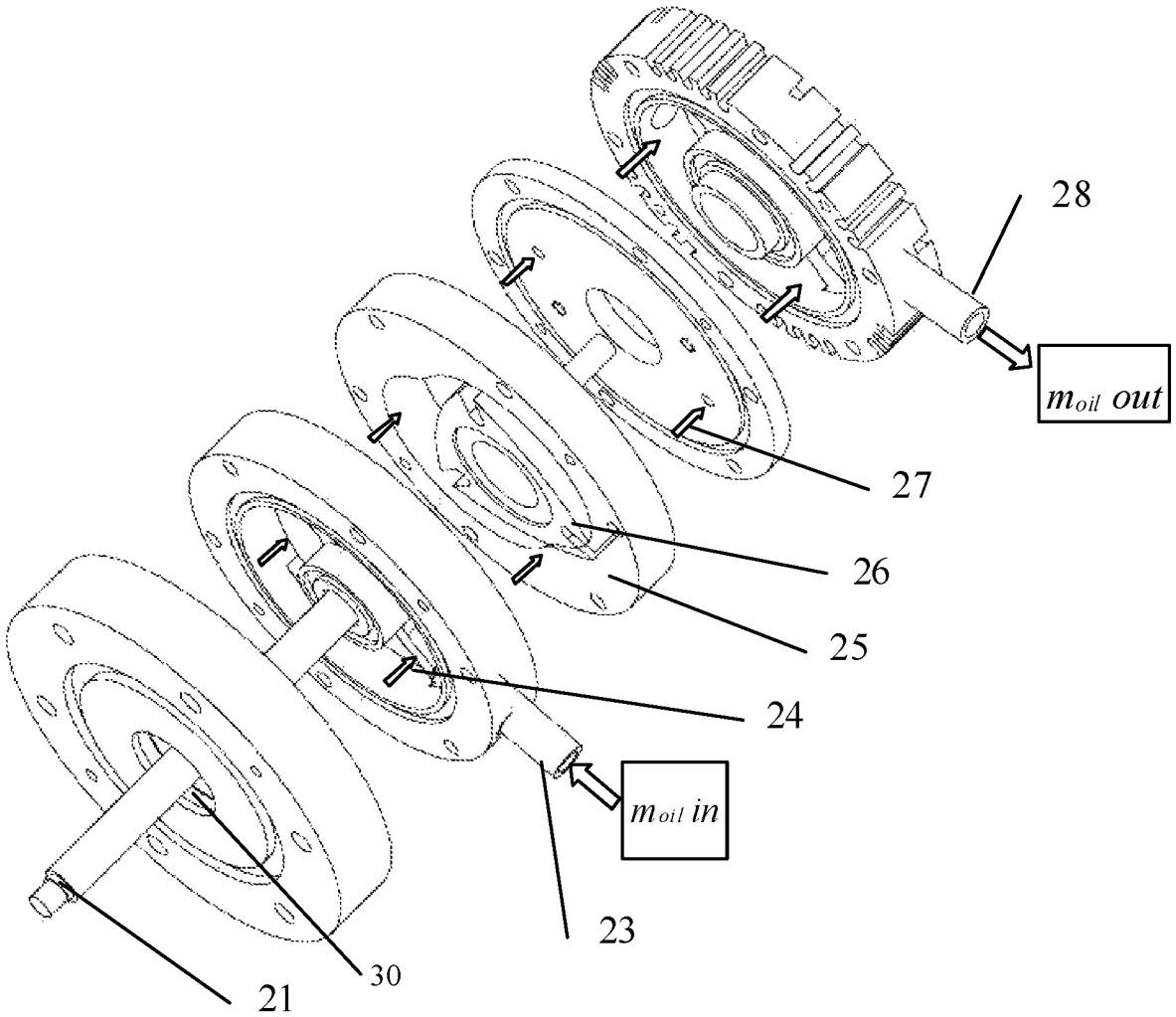
FIG. 6 shows a perspective, exploded view of an embodiment of the compressor in accordance with an embodiment of the subject invention.
Figure 7:
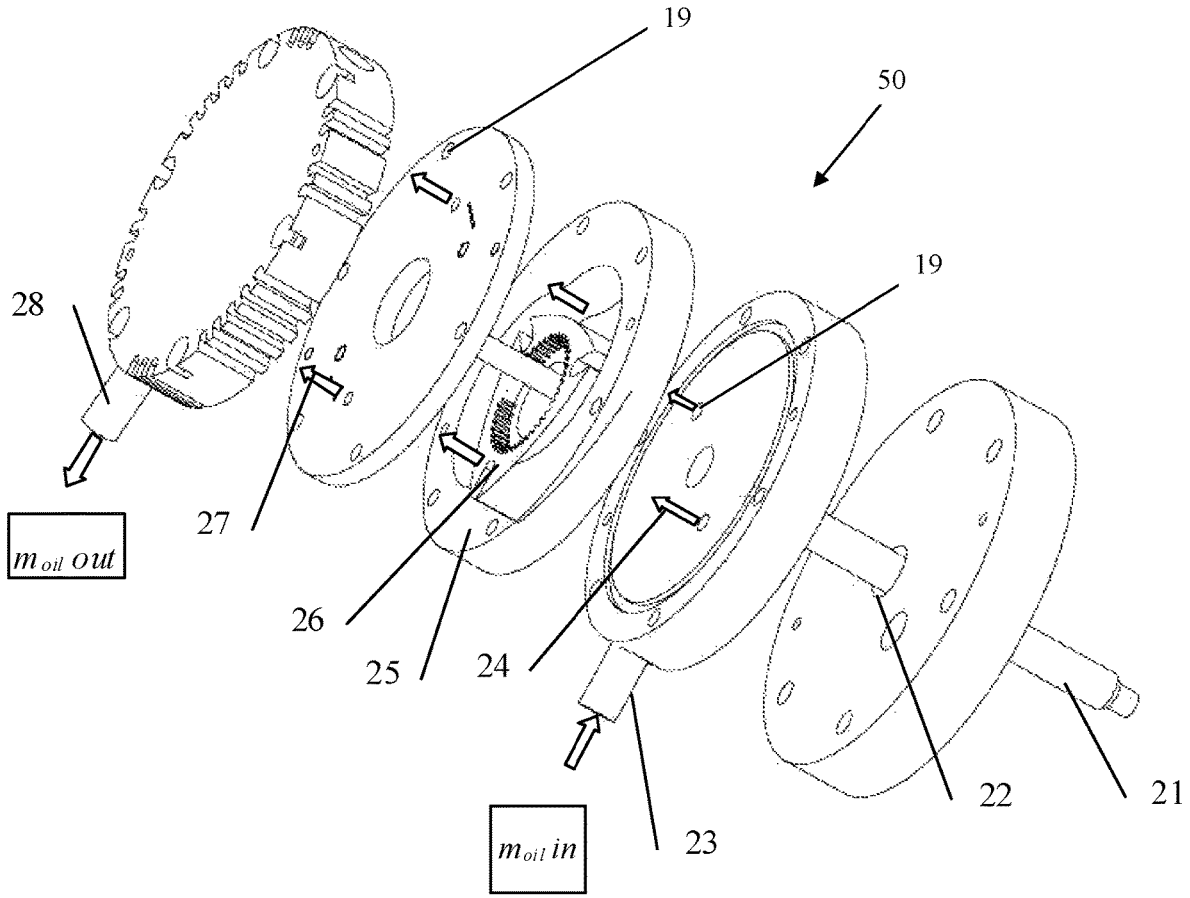
FIG. 7 shows another perspective, exploded view of the embodiment of FIG. 6.
Figure 8:
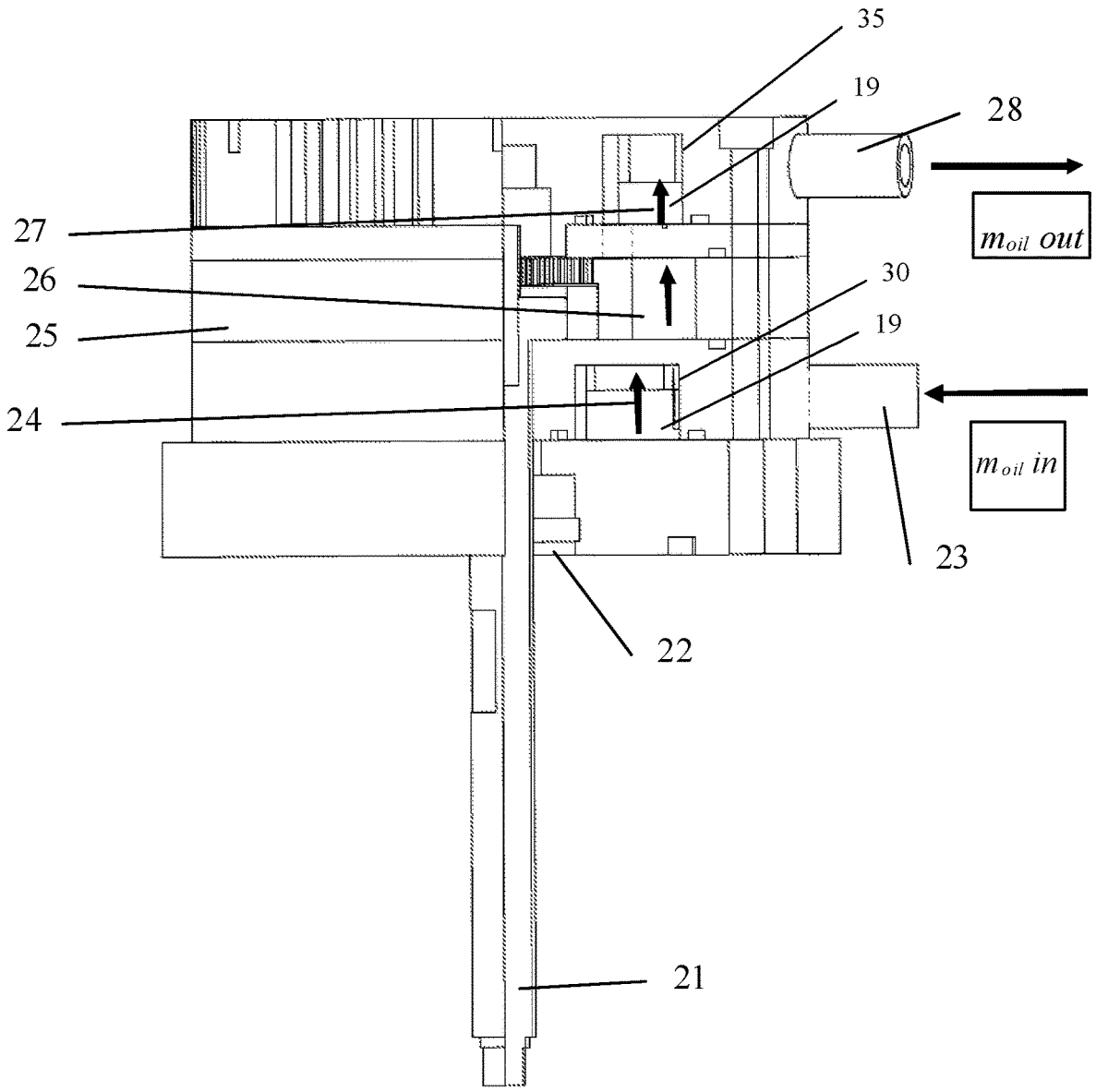
FIG. 8 shows a side view, with cut away, of the embodiment of FIG. 6.

FIGS. 6 and 7 show perspective, exploded views from different angles of a specific embodiment of a compressor that is similar to the compressor shown in FIG. 5. FIG. 8 shows a side view, with cut away, of the embodiment of FIGS. 6 and 7. The reference numbers on FIGS. 6, 7, and 8 correspond to similar structures as referenced by the same reference numbers in FIG. 5. Advantageously, as compressors in accordance with the subject invention do not need oil sumps, the compressors shown in FIGS. 5-8 can be operated, with appropriate modifications of the compressor head as needed, with the working fluid going in the opposite direction as shown in FIGS. 5-8.

Empty volumes for oil to gather can also be reduced or eliminated in other components of the vapor compression cycle system, such as a condenser, an expansion device, an evaporator, and/or interconnecting tubes or other interconnection apparatus, such that these additional components and the flow path, having at least a first segment 30 and a second segment 35, connecting the components to the compressor head do not gather oil in a way that makes the vapor compression cycle system's performance dependent on the orientation of the system with respect to the surrounding gravitational field.

Figure 9:
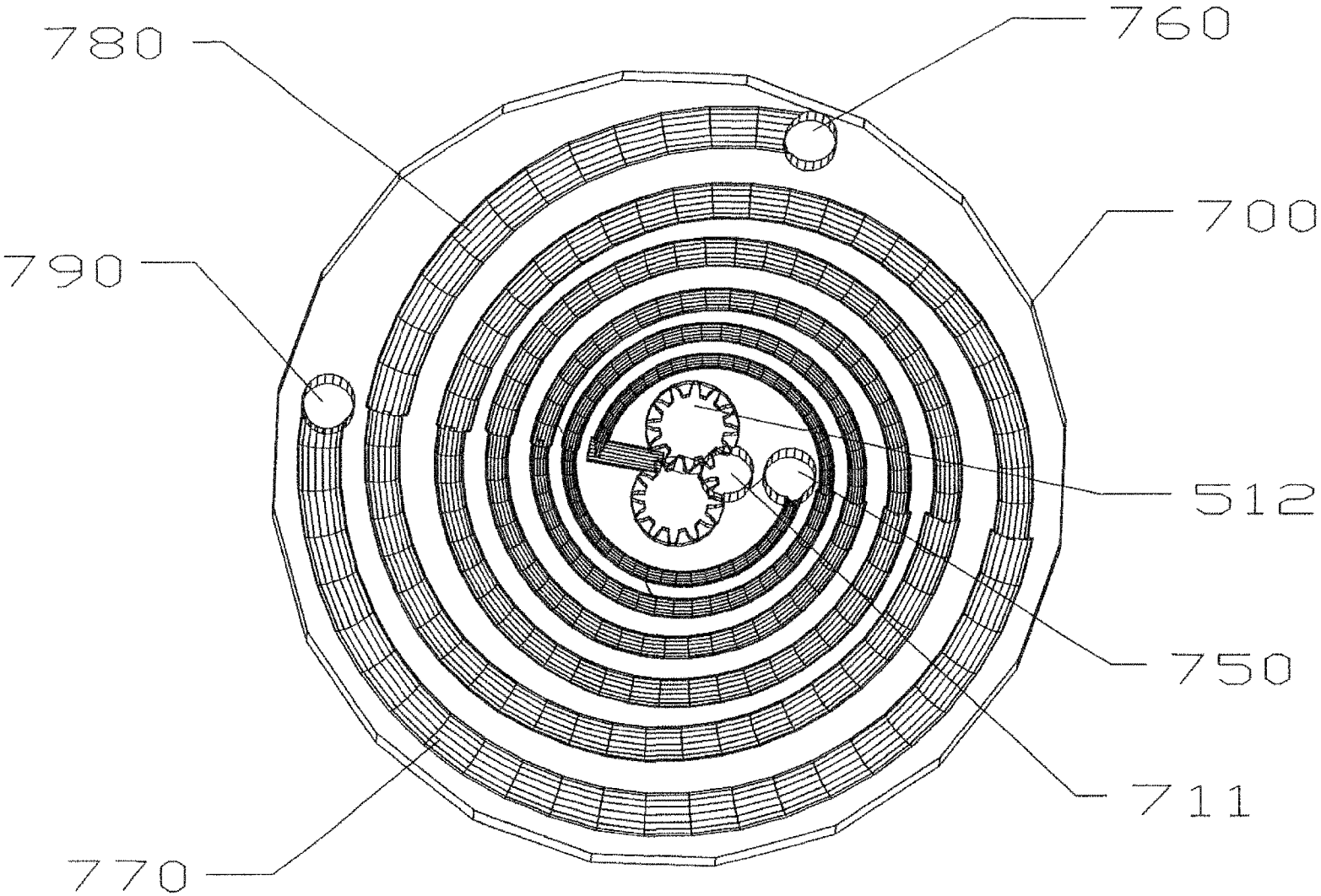
FIG. 9 shows an embodiment of an evaporator in accordance with the subject invention.
Figure 10:
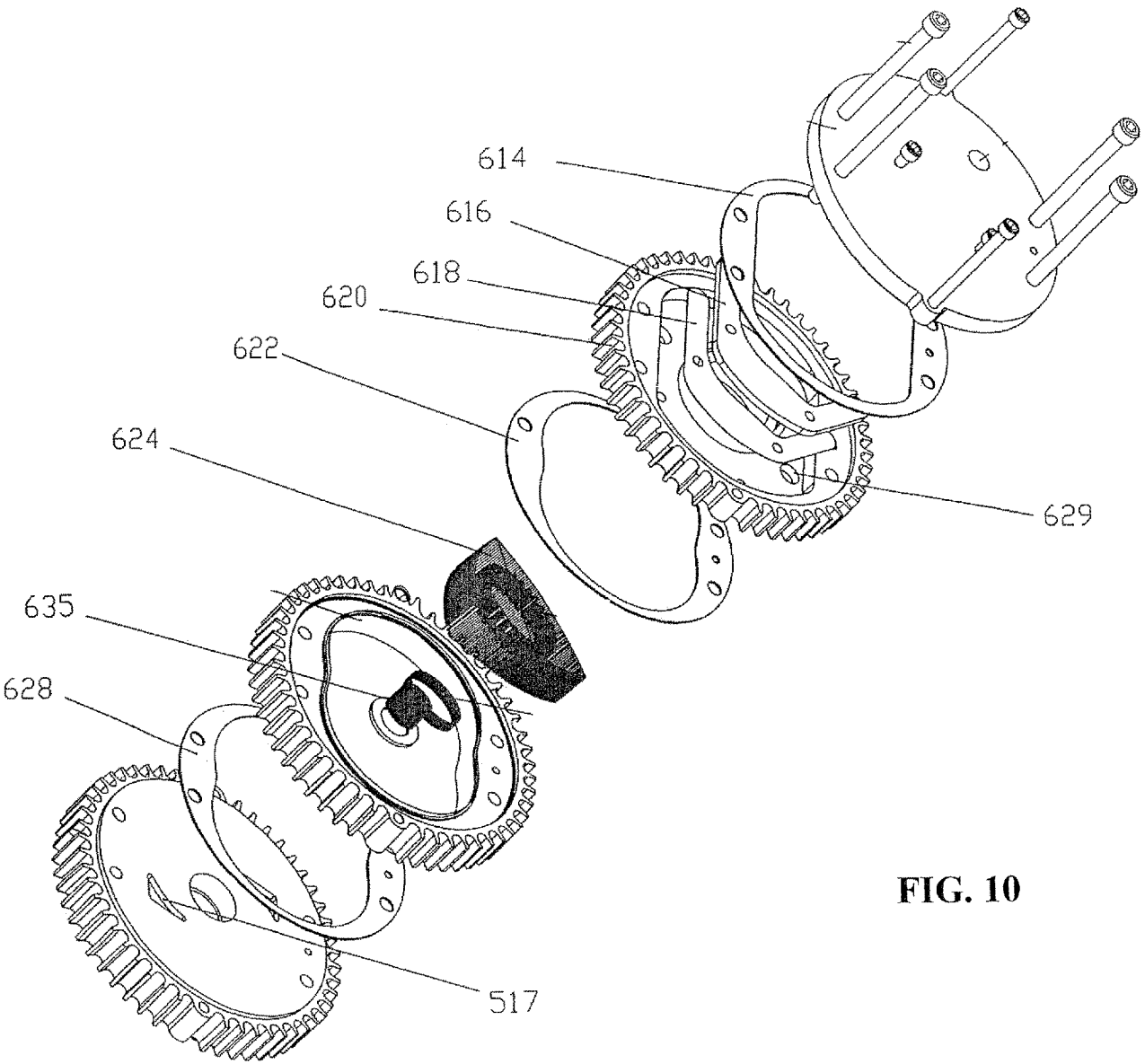
FIG. 10 shows an exploded view of a specific embodiment of a compressor in accordance with the subject invention.
Figure 11B:
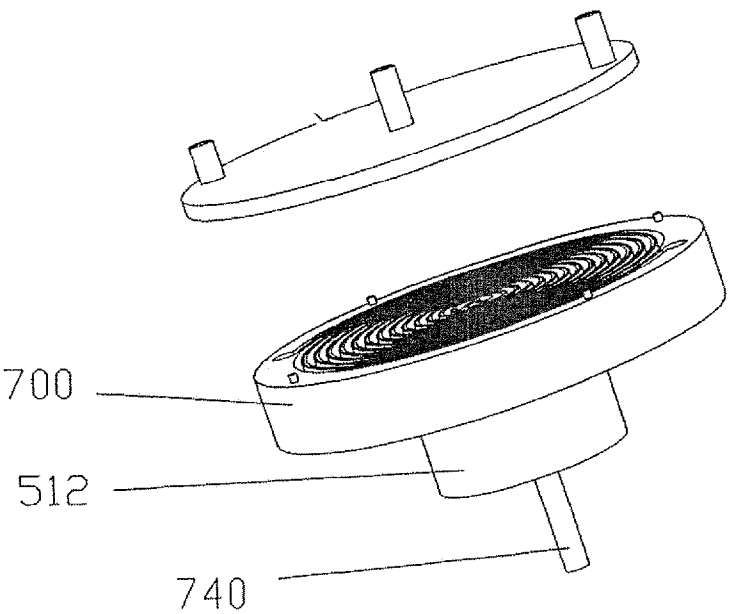
FIGS. 11A and 11B show two views of a specific embodiment of an evaporator in accordance with the subject invention.
Figure 11A:
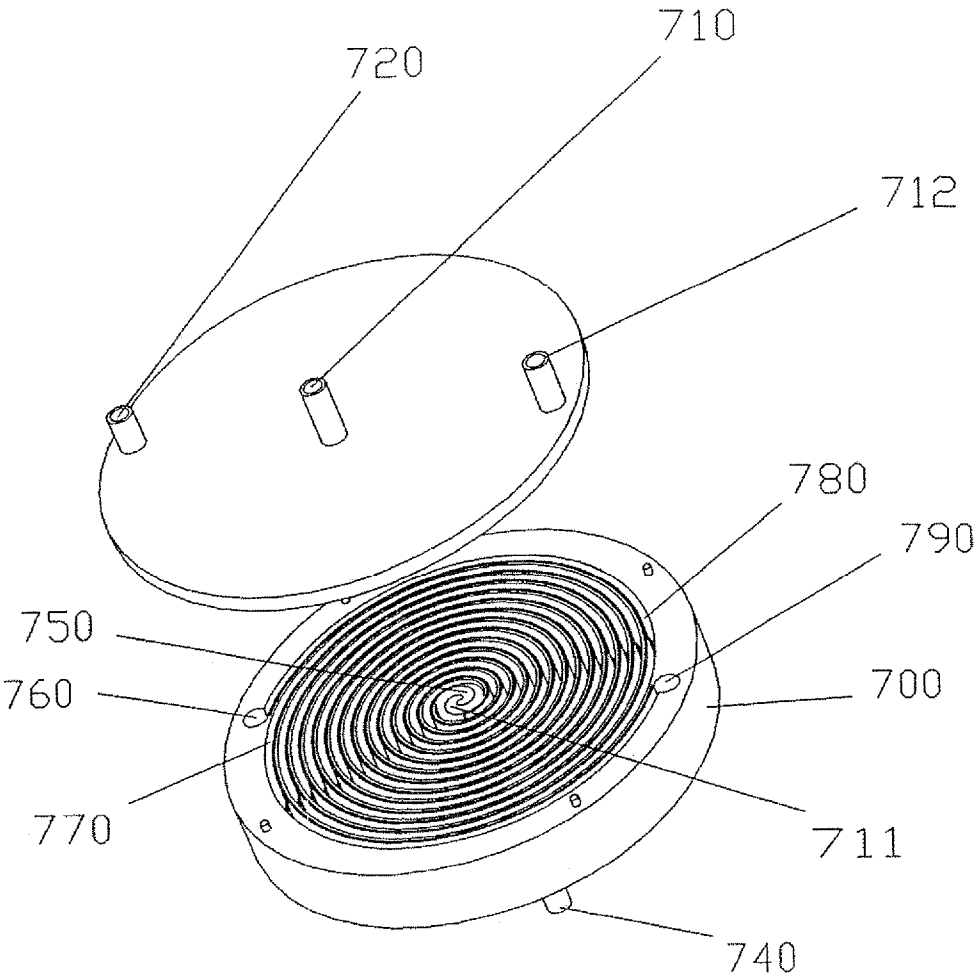

Various embodiments of the subject invention can incorporate one or more of the following taught by U.S. Pat. No. 7,010,936: an evaporator, a compressor, a condenser, and a vapor compression cycle system, where the one or more components allow orientation independent operation of the vapor compression cycle system in accordance with the subject invention. In a particular embodiment, any of the compressors of FIGS. 1-8 can be utilized with the vapor compression cycle system taught in U.S. Pat. No. 7,010,936, wherein the components of the system allow orientation independent operation of the system with respect to the orientation of compressor and/or system with respect to the surrounding gravitational field. FIG. 9 shows an embodiment of an evaporator, as described in U.S. Pat. No. 7,010,936, that can be utilized in accordance with a vapor compression cycle system of the subject invention. FIG. 10 shows an exploded view of a rotary lobe compressor, as described in U.S. Pat. No. 7,010,936, in accordance with an embodiment of the subject invention. FIGS. 11A and 11B show two views of an evaporator that can be used with an embodiment of the subject invention. FIGS. 12A and 12 B show an embodiment of a condenser, as described in U.S. Pat. No. 7,010,936, that can be incorporated with an embodiment of the subject invention. FIGS. 13A and 13B show a schematic of a vapor compression cycle system utilized in a cooling system and a basic vapor compression cycle temperature/entropy diagram, respectively, as described in U.S. Pat. No. 7,010,936, which can be implemented in accordance with the subject invention. Each of these components, and the system, can be implemented to reduce, or eliminate, empty spaces that may cause lubricating oil to become unentrained, so as to reduce or eliminate unentrained oil in the vapor compression cycle system. In specific embodiments, the various embodiments of the compressor and/or vapor compression cycle system described in the subject application can be incorporated into a cooling system as described in U.S. Pat. No. 7,010,936, which is hereby incorporated by reference in its entirety, and in particular for its teaching of various components, including but not limited to, condenser, evaporator, compressor, and expansion device.

Evaporator 700, shown in FIG. 9, can receive the cooled, compressed liquid refrigerant, which can travel through a connector tube and enter evaporator 700 via, for example, throttle device 760. Expanding liquid cools and enters refrigerant evaporation path 780. The refrigerant can exit the evaporator via port 750 and enter a connection tube that terminates at the compressor. The coolant that is to be cooled can enter the evaporator via a coolant connection tube and travel to coolant port 711. A pump 512 can pump the coolant through the cooling path 770. In a specific embodiment, pump 512 is built into the evaporator. Alternatively, a pump external to the evaporator can be utilized. The chilled coolant can exit the evaporator via fluid exit port 790 and flow out of a connection tube.

In an embodiment, referring to FIG. 10, the flow through the compressor can be controlled by inlet port 517 and valved exhaust ports 629. In a specific embodiment, a triangular inlet port 517 design based on the rotational path of the rotor can be used on the bottom face of the compressor. Although a triangular shaped port is shown here, other shapes such as oval, round, and square can also be used. This design can allow the cool refrigerant vapor into the compressor. Rotor 624 can then travel over the top of the intake port so as to close the intake port as rotor 624 begins to compress the refrigerant vapor. This design feature can eliminate the need for an intake check valve, typically used by positive displacement compressors. Exhaust valve 618 and valve stop 616 can be placed on the top face of the compressor and positioned on top of the exhaust port 629 to allow for the maximum compression to occur. The exhaust valve is a check valve that can prevent hot high pressure refrigerant vapor from flowing backwards into the compressor. In a specific embodiment, cantilevered flapper valves can be used to reduce the amount of space required for the outlet port 629.

To reduce the vibrations caused by the mass of the rotor spinning eccentrically in the compressor, a counter balance 635 can be placed on the main shaft. A second rotor can be used to balance the compressor. In embodiment the second rotor can be positioned 180° out of phase with the first rotor so as to counter balance the rotating force. The addition of the second rotor adds complexity to the compressor, but can double the mass flow rate for a given RPM speed. Shaft seals and bearings can be used along the shaft to assist in sealing and to absorb the loads caused by the rotating parts. External sealing can be achieved by the shaft seals and gaskets 614 and 628 while internal sealing of the compression chambers can be accomplished using, for example, a sealing gasket 622 or o-ring.

Figure 12B:
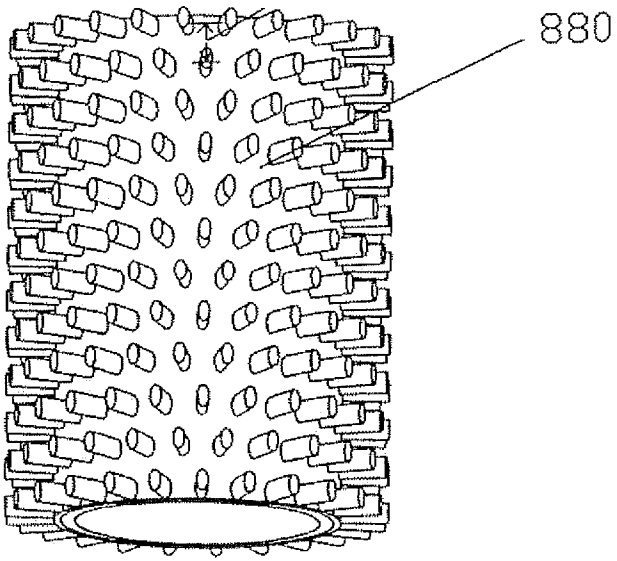
FIG. 12B shows the condenser shown in FIG. 12A with the inner wall piece into the outer wall piece to form a refrigerant annulus.
Figure 12A:
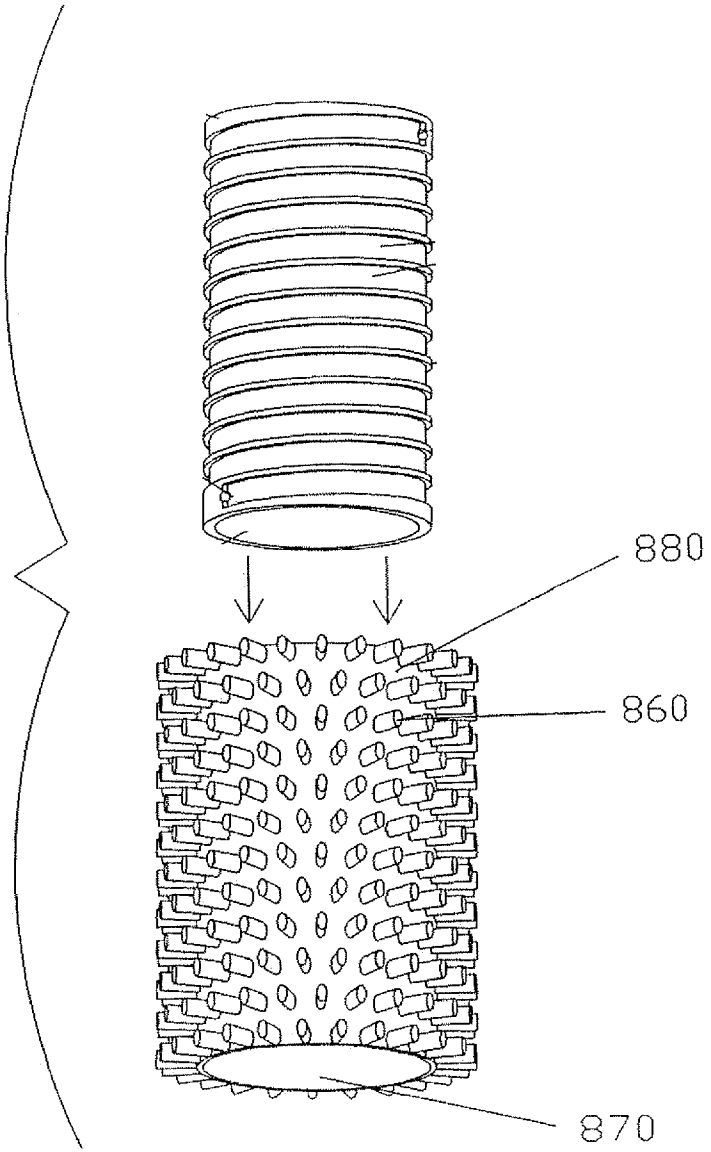
FIG. 12A shows an inner wall piece with a spiral spacer and an outer wall piece with pin fins of a specific embodiment of a condenser in accordance with the subject invention.
Figure 13A:
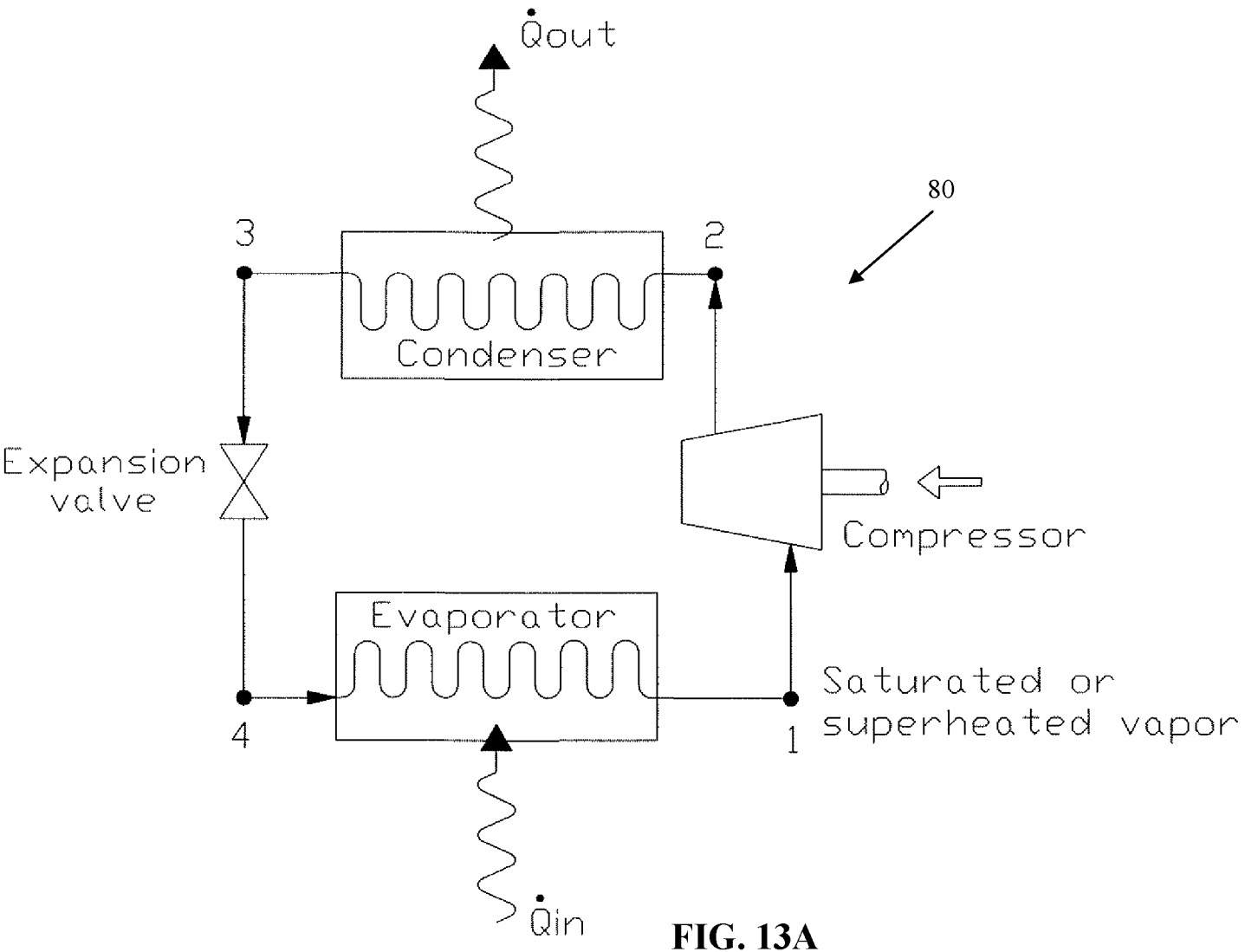
FIG. 13A shows a schematic of a cooling system in accordance with the subject invention, incorporating a condenser, an expansion valve, an evaporator, and a compressor.
Figure 13B:
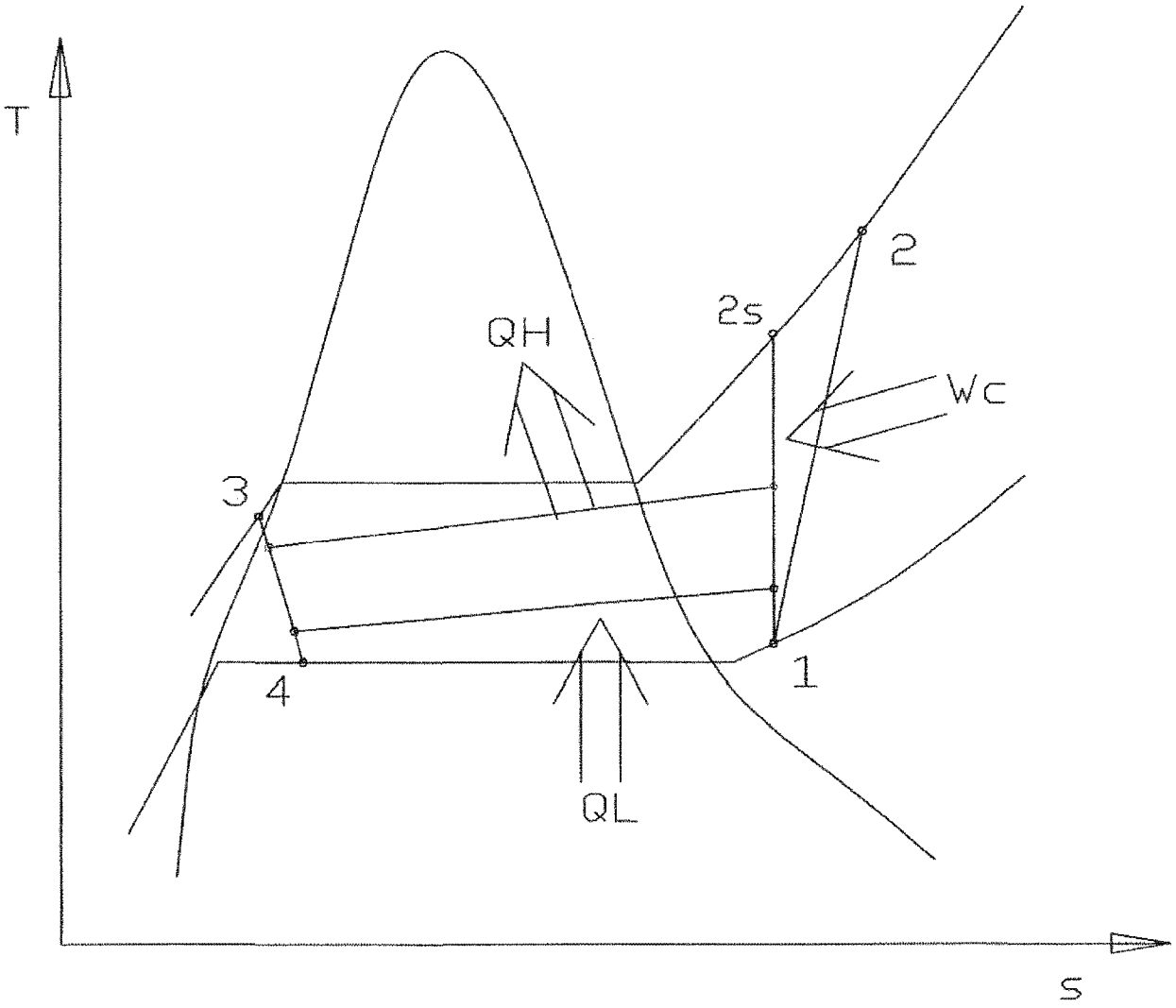
FIG. 13B shows a basic vapor compression cycle temperature/entropy diagram.

In an embodiment, referring to FIGS. 12A and 12B, the fluid that the heat is rejected to can flow through the condenser due to the forces generated by, for example, wind, natural convection, fans, blowers, or compressors. In a specific embodiment, air can be blown into the condenser via, for example, a fan, such that air is blown into the condenser and removes heat from the extended surface features 860.

The condenser can be, for example, a general purpose heat exchanger. On a first side of the heat exchanger the compressed hot refrigerant gas can flow and on a second side of the heat exchanger an external fluid can flow. Typically, ambient air or water can be used on the second side of the heat exchanger. The heat is transferred between the two fluids via dividing wall 870 such that an external fluid flowing on the outer surface, or heat transfer surface 880, of dividing wall 870 will remove heat from dividing wall which has absorbed from the refrigerant flowing through the condenser. The design of the subject condenser can involve optimizing the heat transfer between the two fluids flowing on either side of dividing wall 870.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A compressor, configured to circulate an oil-entrained working fluid vapor in a vapor compression cycle system, the compressor comprising:

a compressor head comprising a compressor head input port that receives the oil-entrained working fluid vapor at an input pressure in a range between 20 psi and 100 psi;

a compressor head output port through which oil-entrained working fluid vapor exits at an output pressure of between 150 psi and 350 psi, a compressor input port;

a compressor output port;

an electric motor that drives the compressor head:

a flow path, configured to constrain the oil entrained working fluid vapor, the flow path comprising, a first segment comprising operating surfaces with an Ra value of between 16 micro-inch and 250 micro-inch that guide the oil-entrained working fluid vapor to a straight path from the compressor input port through the electric motor and to the compressor head input port, wherein the operating surfaces maintain a velocity of the oil-entrained working fluid vapor that is between 0.1 m/sec and 5 m/sec, thereby maintaining the mass flow rate of the oil-entrained working fluid vapor entering the compressor head;

a second segment comprising operating surfaces with an Ra value of between 16 micro-inch and 250 micro-inch that constrain the oil-entrained working fluid vapor between the compressor head output port and the compressor output port, wherein the mass flow rate of the oil-entrained working fluid vapor exiting the compressor output port is substantially equivalent to the mass flow rate of the oil-entrained working fluid vapor entering the compressor head inlet port, independent of the physical orientation of the compressor with respect to the surrounding gravitational field.

2. A method of compressing an oil-entrained working fluid vapor, comprising:

providing a compressor according to claim 1;

inputting the oil-entrained working fluid vapor comprising a mass flow rate of lubricating oil into the compressor input port;

driving the compressor, such that the oil-entrained working fluid vapor input into the compressor input port is guided through the first segment of the flow path, to be compressed in the compressor head, exits the compressor head output port to the second segment, and is subsequently guided through the second segment of the flow path; and outputting the oil-entrained working fluid vapor from the compressor output port with at a mass flow rate substantially the same as the mass flow rate of the oil-entrained working fluid vapor that was input to the compressor input port.

3. The compressor according to claim 1, wherein as the oil-entrained working fluid vapor entering the compressor input port:

flows through the flow path, enters the compressor head via the compressor head input port, is compressed within the compressor head, exits the compressor head via the compressor head output port, and flows through the second segment, the oil-entrained working fluid vapor flows through an oil-vapor flow path, and wherein an amount of internal volume in the oil-vapor flow path that can cause lubricating oil to be removed from the flow of the oil-entrained working fluid vapor through the oil-vapor flow path is sufficiently low that the mass flow rate of lubricating oil in the second segment is substantially the same as the mass flow rate of lubricating oil first segment, independent of the physical orientation of the compressor with respect to the surrounding gravitational field.

4. A closed vapor compression cycle system, configured to circulate an oil-entrained working fluid vapor, the closed vapor compression cycle system comprising:

a compressor comprising;

a compressor input port that receives an oil-entrained working fluid vapor, a compressor output port through which the oil-entrained working fluid vapor exits the compressor, a compressor head between the compressor input port and the compressor output port, the compressor head comprising;

a compressor head input port, a compressor head output port, an electric motor, for driving the compressor, located between the compressor input port and the compressor output port, a flow path comprising, a first segment that forms a straight path through the electric motor, the first segment comprising operating surfaces with an Ra value of between 16 micro-inch and 250 micro-inch and that are integral with the compressor input port and the compressor head input port, such that there is a defined flow path through the electric motor for the oil-entrained working fluid vapor from the compressor input port to the compressor head input port, a second segment having operating surfaces with an Ra value of between 16 micro-inch and 250 micro-inch and that are integral with the compressor head output port and the compressor output port, such that there is a defined flow path for the oil-entrained working fluid vapor that exits the compressor head output port to the compressor output port, wherein the oil-entrained working fluid vapor that exits the compressor output port has a mass flow rate that is substantially equivalent to the mass flow rate of the oil-entrained working fluid vapor that enters the compressor input port, independent of the physical orientation of the compressor.

5. The closed vapor compression cycle system according to claim 4, the flow path further comprising an angle having a radii of curvature that is greater than 0.250".

6. The closed vapor compression cycle system according to claim 5, the flow path further comprising an angle having a radii of curvature that is greater than 0.050".

7. The closed vapor compression cycle system according to claim 4, wherein the flow path comprises a filler material that fills voids in the motor to form the flow path.

8. The closed vapor compression cycle system according to claim 7, wherein the filler material comprising one or more of metals, epoxies, plastics, and rubbers.

9. A compressor, configured to operate in a closed vapor compression cycle system, the compressor comprising:

a compressor input port;

a first segment of a flow path having operating surfaces with an Ra value of between 16 micro-inch and 250 micro-inch, the first segment being integral with the compressor input port;

a compressor head comprising, a compressor head input port integral with the first segment; and a compressor head output port;

a compressor output port;

a second segment of the flow path integral with the compressor head output port, the second segment having operating surfaces with an Ra value of between 16 micro-inch and 250 micro-inch;

wherein the compressor receives through the compressor input port an oil-entrained working fluid vapor having a mass flow rate of lubricating oil that is at least 80% of a maximum mass flow rate of lubricating oil, wherein the oil-entrained working fluid vapor:

flows through and is guided within the first segment of the flow path from the compressor input port to the compressor head input port, enters the compressor head, at an input pressure, via the compressor head input port, compresses by the action of the compressor head, exits the compressor head via the compressor head output port at an output pressure that is higher than the input pressure, enters and is guided by the second segment of the flow path from the compressor head output port to the compressor output port, and exits the compressor output port, such that the oil-entrained working fluid vapor output from the compressor output port has a mass flow rate substantially equivalent to the mass flow rate of the oil-entrained working fluid vapor that enters the compressor through the compressor input port, independent of the physical orientation of the compressor with respect to the surrounding gravitational field.

10. The compressor according to claim 9, wherein the mass flow rate of the oil-entrained working fluid vapor entering the compressor input port is at least 90% of the maximum mass flow rate, independent of the physical orientation of the compressor with respect to the surrounding gravitational field.

11. A method of compressing an oil-entrained working fluid vapor comprising:

providing a compressor according to claim 9;

inputting oil-entrained working fluid vapor having the mass flow rate to the compressor input port;

driving the compressor, such that the oil-entrained working fluid vapor entering the compressor input port flows through the first segment, is compressed in the compressor head, and flows through the second segment; and outputting oil-entrained working fluid vapor having substantially the same mass flow rate from the compressor output port.

12. The compressor according to claim 9, wherein the mass flow rate of the oil-entrained working fluid vapor entering the compressor input port is at least 95% of the maximum mass flow rate, independent of the physical orientation of the compressor with respect to the surrounding gravitational field.

13. The compressor according to claim 12, wherein the lubricating oil comprises a miscible lubricating oil.

14. The compressor according to claim 12, wherein the lubricating oil comprises polyester oil.

15. The compressor according to claim 12, wherein the lubricating oil comprises a lubricating oil selected from the group consisting of:

a mineral oil, a Polyalkylene Glycol oil, an Alkylbenzene oil, and a Polyol Ester oil.

16. The compressor according to claim 12, wherein the compressor is a positive displacement compressor.

17. The compressor according to claim 12, wherein the compressor is a rotary lobed type positive displacement compressor.

18. The compressor according to claim 12, wherein the compressor is selected from the following group:

a rotary compressor, a piston compressor, and a centrifugal compressor.

19. The compressor according to claim 12, wherein when the compressor is interconnected with the flow path to form the closed vapor compression cycle system, the closed vapor compression cycle system is charged with working fluid vapor and lubricating oil, and the compressor is driven, the oil-entrained working fluid vapor is:

output from the compressor output port into an input of the flow path, passes through the flow path, and is output from an output of the flow path into the compressor input port, such that the mass flow rate of the working fluid vapor entering the compressor input port is maintained throughout the first segment, the compressor head, and the second segment as the oil-entrained working fluid vapor passes from the compressor input port to the compressor output port, independent of the physical orientation of the compressor with respect to the surrounding gravitational field.

20. The compressor according to claim 12, wherein the compressor further comprises:

a compressor shaft; and an electric motor, wherein the electric motor drives the compressor shaft, and wherein the first segment passes through the electric motor.

21. The compressor according to claim 12,
wherein when the compressor is interconnected with the flow path to form the closed vapor compression cycle system, the closed vapor compression cycle system is charged with working fluid vapor and lubricating oil, and the compressor is driven, the oil-entrained working fluid vapor is:
output from the compressor output port into an input of the flow path,
passes through the flow path, and
is output from an output of the flow path into the compressor input port,
such that a volume in the first segment in which lubricating oil gathers and is not exposed to the oil-entrained working fluid vapor passing at a velocity sufficient to entrain the gathered lubricating oil is less than 1% of a volume of the input flow path, independent of the physical orientation of the compressor with respect to the surrounding gravitational field.

22. The compressor according to claim 12,
wherein when the compressor is interconnected with the flow path to form the closed vapor compression cycle system, the closed vapor compression cycle system is charged with working fluid vapor and lubricating oil, and the compressor is driven, the oil-entrained working fluid vapor is:
output from the compressor output port into an input of the flow path,
passes through the flow path, and
is output from an output of the flow path into the compressor input port,
such that the lubricating oil entrained in the oil-entrained working fluid vapor entering the compressor head input port lubricates the compressor head, independent of the physical orientation of the compressor with respect to the surrounding gravitational field.

23. The compressor according to claim 12,
wherein when the compressor is interconnected with the flow path to form the closed vapor compression cycle system, the closed vapor compression cycle system is charged with working fluid vapor and lubricating oil, and the compressor is driven, the oil-entrained working fluid vapor is:
output from the compressor output port into an input of the flow path,
passes through the flow path, and
is output from an output of the flow path into the compressor input port,
such that a volume in the flow path in which lubricating oil gathers and is not exposed to the oil-entrained working fluid vapor passing at a velocity sufficient to entrain the gathered lubricating oil is less than 10% of a volume of the first segment, independent of the physical orientation of the compressor with respect to the surrounding gravitational field.

24. The compressor according to claim 23,
wherein the volume of the first segment is less than 100 $cm^3$.

25. The compressor according to claim 12,
wherein when the compressor is interconnected with the flow path to form the closed vapor compression cycle system, the closed vapor compression cycle system is charged with working fluid vapor and lubricating oil, and the compressor is driven, the oil-entrained working fluid vapor is:
output from the compressor output port into an input of the flow path,
passes through the flow path, and
is output from an output of the flow path into the compressor input port,
such that a mass flow rate of the oil-entrained working fluid vapor in the first segment is in the range of 0.1-10%, independent of the physical orientation of the compressor with respect to the surrounding gravitational field.

26. The compressor according to claim 25,
wherein when the compressor is interconnected with the flow path to form the closed vapor compression cycle system, the closed vapor compression cycle system is charged with working fluid vapor and lubricating oil, and the compressor is driven, the oil-entrained working fluid vapor is:
output from the compressor output port into the input of the flow path,
passes through the flow path, and
is output from the output of the flow path into the compressor input port,
such that the mass flow rate of the oil-entrained working fluid vapor in the first segment is in the range of 1-2%, independent of the physical orientation of the compressor with respect to the surrounding gravitational field.

27. The compressor according to claim 12,
wherein the working fluid vapor comprises at least one of a gas and a refrigerant vapor.

28. The compressor according to claim 27,
wherein the refrigerant vapor is a hydrogen fluorocarbon refrigerant.

29. The compressor according to claim 27,
wherein the refrigerant vapor comprises a refrigerant selected from the group consisting of:
r-134a,
r-22,
$CO_2$, and
$NH_3$.

30. The compressor according to claim 29,
wherein the refrigerant vapor with entrained lubricating oil output from the output of the flow path into the compressor input port flows through the first segment, the compressor head, and the second segment, and is output from the compressor output port, at a velocity in the range of 0.1 m/sec-5 m/sec, independent of the physical orientation of the compressor with respect to the surrounding gravitational field.

31. The compressor according to claim 30,
wherein the refrigerant vapor with entrained lubricating oil output from the output of the flow path into the compressor input port flows through the first segment, the compressor head, and the second segment, and is output from the compressor output port, at a velocity of at least 2 m/sec.

32. A closed vapor compression cycle system, configured to circulate an oil-entrained working fluid vapor, the closed vapor compression cycle system comprising:
a system flow path having a first segment and a second segment each with operating surfaces that constrain the oil-entrained working fluid vapor in the system flow path; and
a compressor comprising,
a compressor head comprising,
a compressor head input port
configured to receive the oil-entrained working fluid vapor from the first segment of the system flow path, at an input pressure of between 20 psi and 100 psi and a mass flow rate of oil that is between 0.1% and 10%;

a compressor head output port
through which oil-entrained working fluid vapor exits to the second segment of the system flow path, at an output pressure,
that is between about 50 psi and about 330 psi higher than the input pressure and having a mass flow rate that is at least equivalent to the mass flow rate of the oil-entrained working fluid vapor that entered the compressor head input port;
a compressor input port through which the oil-entrained working fluid vapor is received by the first segment from the vapor compression cycle system;
a motor that drives the compressor head;
such that the oil-entrained working fluid vapor that enters the compressor input port is constrained within the first segment and guided in a straight path through the motor and to the compressor head input port,
a compressor output port through which the oil-entrained working fluid vapor exits the compressor head to be circulated through the vapor compression cycle system; and
such that when the oil-entrained working fluid vapor exits the compressor head output port, the oil-entrained working fluid vapor is guided to the compressor output port by the second segment of the system flow path,
wherein the mass flow rate of lubricating oil circulating in the system flow path is at least 80% of a compressor maximum mass flow rate of lubricating oil, such that the mass flow rate of the lubricating oil in the oil-entrained working fluid vapor guided by the first segment of the system flow path is substantially the same as the mass flow rate of lubricating oil in the oil-entrained working fluid vapor that enters the second segment of the system flow path, independent of the physical orientation of the compressor with respect to the surrounding gravitational field.

33. The system according to claim 32,
wherein the working fluid vapor comprises a gas.

34. The system according to claim 32,
wherein the lubricating oil comprises a miscible lubricating oil.

35. The system according to claim 32,
wherein the lubricating oil comprises polyester oil.

36. The system according to claim 32,
wherein the lubricating oil comprises a lubricating oil selected from the group consisting of:
a mineral oil,
a Polyalkylene Glycol oil,
an Alkylbenzene oil. and
a Polyol Ester oil.

37. The system according to claim 32,
wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:
output from the compressor output port into an input of the system flow path,
passes through the system flow path, and
is output from an output of the system flow path into the compressor input port,
such that the oil-entrained working fluid vapor output from the output of the system flow path into the compressor input port flows through the first segment, the compressor head, and the second segment, and is output from the compressor output port, at a velocity sufficient to keep the lubricating oil in the oil-entrained working fluid vapor entering the compressor output port entrained in the oil-entrained working fluid vapor from the compressor input port to the compressor output port, independent of the physical orientation of the system with respect to the surrounding gravitational field.

38. The system according to claim 32,
wherein the compressor is a positive displacement compressor.

39. The system according to claim 32,
wherein the compressor is a rotary lobed type positive displacement compressor.

40. The system according to claim 32,
wherein the compressor is selected from the following group:
a rotary compressor,
a piston compressor, and
a centrifugal compressor.

41. The system according to claim 32,
wherein when the compressor is interconnected with the system flow path to form the closed vapor compression cycle system, the closed vapor compression cycle system is charged with working fluid vapor and lubricating oil, and the compressor is driven, oil-entrained working fluid vapor is:
output from the compressor output port into an input of the system flow path,
passes through the system flow path, and
is output from an output of the system flow path into the compressor input port,
such that the first mass flow rate of the oil-entrained working fluid vapor entering the compressor input port is maintained throughout the compressor and the system flow path, independent of the physical orientation of the system with respect to the surrounding gravitational field.

42. The system according to claim 32,
wherein the system is configured such that when the compressor is interconnected with the system flow path to form the closed vapor compression cycle system, the closed vapor compression cycle system is charged with working fluid vapor and lubricating oil, and the compressor is driven, the oil-entrained working fluid vapor is:
output from the compressor output port into an input of the system flow path,
passes through the system flow path, and
is output from an output of the system flow path into the compressor input port,
such that a mass flow rate of the oil-entrained working fluid vapor in the first segment is in the range of 0.1-10%, independent of the physical orientation of the system with respect to the surrounding gravitational field.

43. The system according to claim 32,
wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:
output from the compressor output port into an input of the system flow path,
passes through the system flow path, and
is output from an output of the system flow path into the compressor input port,
such that a mass flow rate of lubricating oil of the oil-entrained working fluid vapor in the first segment is in the range of 1-2%, independent of the physical orientation of the system with respect to the surrounding gravitational field.

44. The system according to claim 32, wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:

output from the compressor output port into an input of the system flow path, passes through the system flow path, and is output from an output of the system flow path into the compressor input port, such that a volume in the system flow path in which lubricating oil gathers and is not exposed to the oil-entrained working fluid vapor passing at a velocity sufficient to entrain the gathered lubricating oil is less than 10% of a volume of the system flow path, independent of the orientation of the system with respect to the surrounding gravitational field.

45. The system according to claim 44, wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:

output from the compressor output port into the input of the system flow path, passes through the system flow path, and is output from the output of the system flow path into the compressor input port, such that a volume in the system flow path in which lubricating oil gathers and is not exposed to the oil-entrained working fluid vapor passing at the velocity sufficient to entrain the gathered lubricating oil is less than 1% of a volume of the system flow path, independent of the orientation of the system with respect to the surrounding gravitational field.

46. The system according to claim 45, wherein the volume of the system flow path is less than 100 $cm^3$.

47. The system according to claim 32, wherein the working fluid vapor is a refrigerant vapor.

48. The system according to claim 47, wherein the refrigerant vapor is a hydrogen fluorocarbon refrigerant.

49. The system according to claim 47, wherein the refrigerant vapor comprises a refrigerant selected from the group consisting of:

r-134a, r-22, $CO_2$, and $NH_3$.

50. The system according to claim 49, wherein refrigerant vapor with entrained lubricating oil output from an output of the system flow path into the compressor input port flows through the first segment, the compressor head, and the second segment, and is output from the compressor output port, at a velocity in the range of 0.1 m/sec-5 m/sec, independent of the physical orientation of the system with respect to the surrounding gravitational field.

51. A method of compressing an oil-entrained working fluid vapor, comprising:

providing a closed vapor compression cycle system according to claim 32;

interconnecting the compressor with the system flow path to form the closed vapor compression cycle system;

charging the closed vapor compression cycle system with an oil-entrained working fluid vapor; and driving the compressor, such that the oil-entrained working fluid vapor flows through the closed vapor compression cycle system.

52. The method according to claim 51, wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:

output from the compressor output port into an input of the system flow path, passes through the system flow path, and is output from an output of the system flow path into the compressor input port, such that the mass flow rate of lubricating oil in the oil-entrained working fluid vapor entering the compressor input port is at least 90% of the compressor maximum mass flow rate, independent of the physical orientation of the compressor with respect to the surrounding gravitational field.

53. The method according to claim 52, wherein when the compressor is interconnected with the system flow path to form the closed vapor compression cycle system, the closed vapor compression cycle system is charged with working fluid vapor and lubricating oil, and the compressor is driven, oil-entrained working fluid vapor is:

output from the compressor output port into the input of the system flow path, passes through the system flow path, and is output from the output of the system flow path into the compressor input port, such that the mass flow rate of lubricating oil in the oil-entrained working fluid vapor entering the compressor input port is at least 90% of the system maximum mass flow rate, independent of the physical orientation of the system with respect to the surrounding gravitational field.

54. The method according to claim 51, wherein when the compressor is interconnected with the system flow path to form the closed vapor compression cycle system, the closed vapor compression cycle system is charged with working fluid vapor and lubricating oil, and the compressor is driven, the oil-entrained working fluid vapor is:

output from the compressor output port into an input of the system flow path, passes through the system flow path, and is output from an output of the system flow path into the compressor input port, such that the mass flow rate of lubricating oil in the oil-entrained working fluid vapor entering the compressor input port is at least 95% of the compressor maximum mass flow rate, independent of the physical orientation of the compressor with respect to the surrounding gravitational field.

55. The method according to claim 54, wherein when the compressor is interconnected with the system flow path to form the closed vapor compression cycle system, the closed vapor compression cycle system is charged with working fluid vapor and lubricating oil, and the compressor is driven, oil-entrained working fluid vapor is:

output from the compressor output port into the input of the system flow path, passes through the system flow path, and is output from the output of the system flow path into the compressor input port, such that the mass flow rate of lubricating oil in the oil-entrained working fluid vapor entering the compressor input port is at least 95% of the system maximum mass flow rate, independent of the physical orientation of the system with respect to the surrounding gravitational field.

56. The method according to claim 55, wherein the system flow path comprises:

a condenser, wherein the condenser receives oil-entrained working fluid vapor outputted by the compressor output port and outputs working fluid and lubricating oil;

an expansion device, wherein the expansion device receives the working fluid and lubricating oil from the condenser, and wherein the working fluid and lubricating oil received from the condenser is expanded through the expansion device and the expansion device outputs oil-entrained working fluid vapor;

an evaporator, wherein the oil-entrained working fluid vapor exiting the expansion device flows through the evaporator and the expansion device outputs oil-entrained working fluid vapor, and wherein the oil-entrained working fluid vapor exiting the evaporator is input to the compressor input port.

57. The method according to claim 56, wherein the condenser has a heat transfer surface, wherein the condenser acts as a heat exchanger so that heat is removed from the oil-entrained working fluid vapor by a first external fluid in thermal contact with the heat transfer surface of the condenser, wherein the evaporator is in thermal contact with a heat source, and wherein the oil-entrained working fluid vapor absorbs heat from the heat source as the oil-entrained working fluid vapor passes through the evaporator.

* * * * *